US008474816B2

(12) United States Patent
Ishizaki et al.

(10) Patent No.: US 8,474,816 B2
(45) Date of Patent: Jul. 2, 2013

(54) SHEET CONVEYING DEVICE, IMAGE FORMING APPARATUS, SHEET CONVEYING MOTOR CONTROL SYSTEM, AND STORAGE MEDIUM

(75) Inventors: Yuusuke Ishizaki, Kanagawa (JP); Takahisa Koike, Tokyo (JP); Minoru Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/525,448

(22) Filed: Jun. 18, 2012

(65) Prior Publication Data

US 2012/0326387 A1 Dec. 27, 2012

(30) Foreign Application Priority Data

Jun. 21, 2011 (JP) ..... 2011-137248
May 11, 2012 (JP) ..... 2012-109953

(51) Int. Cl.
*B65H 5/34* (2006.01)

(52) U.S. Cl.
USPC ..... 271/270; 271/202; 271/265.02

(58) Field of Classification Search
USPC ..... 271/202, 270, 265.02
See application file for complete search history.

(56) References Cited

U.S. PATENT DOCUMENTS

| | | | | |
|---|---|---|---|---|
| 5,022,644 | A * | 6/1991 | Burge | 271/270 |
| 6,783,290 | B2 * | 8/2004 | Sussmeier | 400/608.4 |
| 7,731,167 | B2 * | 6/2010 | Prim et al. | 270/52.22 |
| 7,954,813 | B2 * | 6/2011 | Matsumoto | 271/270 |
| 8,172,218 | B2 * | 5/2012 | Suzuki et al. | 271/10.01 |
| 2008/0298856 | A1 | 12/2008 | Koike | |
| 2010/0239293 | A1 | 9/2010 | Ishizaki et al. | |
| 2011/0229163 | A1 | 9/2011 | Ishizaki | |
| 2012/0070168 | A1 | 3/2012 | Ishizaki | |
| 2013/0049284 | A1 * | 2/2013 | Mandel et al. | 271/3.18 |

FOREIGN PATENT DOCUMENTS

| | | |
|---|---|---|
| JP | 2005-025077 | 1/2005 |
| JP | 2006-133816 | 5/2006 |
| JP | 2008-304801 | 12/2008 |
| JP | 2009-009103 | 1/2009 |
| JP | 2010-134061 | 6/2010 |

* cited by examiner

*Primary Examiner* — Prasad Gokhale
(74) *Attorney, Agent, or Firm* — IPUSA, PLLC

(57) ABSTRACT

A sheet conveying device includes a first rotator, a second rotator, and a third rotator, at least one of which is configured to convey a sheet medium; a first detection unit configured to detect a first control factor for controlling a first motor that rotates the first rotator; a second detection unit configured to detect a second control factor for controlling a second motor that rotates the second rotator; a motor control unit configured to control a rotational speed of a third motor that rotates the third rotator; and a speed control unit configured to request the motor control unit to change the rotational speed of the third motor based on the sum of the first control factor and the second control factor.

10 Claims, 17 Drawing Sheets

SHEET CONVEYING DEVICE, IMAGE FORMING APPARATUS, SHEET CONVEYING MOTOR CONTROL SYSTEM, AND STORAGE MEDIUM

CROSS-REFERENCE TO RELATED APPLICATIONS

The present application is based upon and claims the benefit of priority of Japanese Patent Application No. 2011-137248 filed on Jun. 21, 2011 and Japanese Patent Application No. 2012-109953 filed on May 11, 2012, the entire contents of which are incorporated herein by reference.

BACKGROUND OF THE INVENTION

1. Field of the Invention

A certain aspect of this disclosure relates to a sheet conveying device, an image forming apparatus, a sheet conveying motor control system, and a storage medium.

2. Description of the Related Art

There is a known technology for reducing the interference between two rollers being rotated by different driving sources, by monitoring the currents used to drive the rollers.

For example, in an image forming apparatus, an intermediate transfer belt and a secondary transfer roller are in contact with each other and driven by different driving sources, and therefore they interfere with each other. Also, the secondary transfer roller and a repulsive roller are driven by different driving sources, and interfere with each other via a sheet medium. In such an image forming apparatus, driving currents of the secondary transfer roller and an intermediate transfer roller for rotating the intermediate transfer belt and driving currents of the secondary transfer roller and the repulsive roller are monitored to reduce their interference and to prevent their operations from becoming unstable due to, for example, a decrease in the driving currents.

For example, Japanese Laid-Open Patent Publication No. 2008-304801 discloses a technology where currents of two different driving sources are detected and the speeds of the driving sources are controlled to reduce interference.

With the related-art technologies described above, although it may be possible to monitor and control the driving currents of two rotators being driven by different driving sources, it is not possible to reduce the interference among three or more rotators being driven by different driving sources. For example, an image forming apparatus includes three or more rotators, such as a registration roller, an intermediate transfer roller, and a secondary transfer roller, that are driven by different driving sources. The related-art technologies do not provide a mechanism for reducing the interference among three or more rotators in such an image forming apparatus.

SUMMARY OF THE INVENTION

In an aspect of this disclosure, there is provided a sheet conveying device that includes a first rotator, a second rotator, and a third rotator, at least one of which is configured to convey a sheet medium; a first detection unit configured to detect a first control factor for controlling a first motor that rotates the first rotator; a second detection unit configured to detect a second control factor for controlling a second motor that rotates the second rotator; a motor control unit configured to control a rotational speed of a third motor that rotates the third rotator; and a speed control unit configured to request the motor control unit to change the rotational speed of the third motor based on the sum of the first control factor and the second control factor.

DESCRIPTION OF THE PREFERRED EMBODIMENTS

Preferred embodiments of the present invention are described below with reference to the accompanying drawings.

<First Embodiment>

Figure 1:
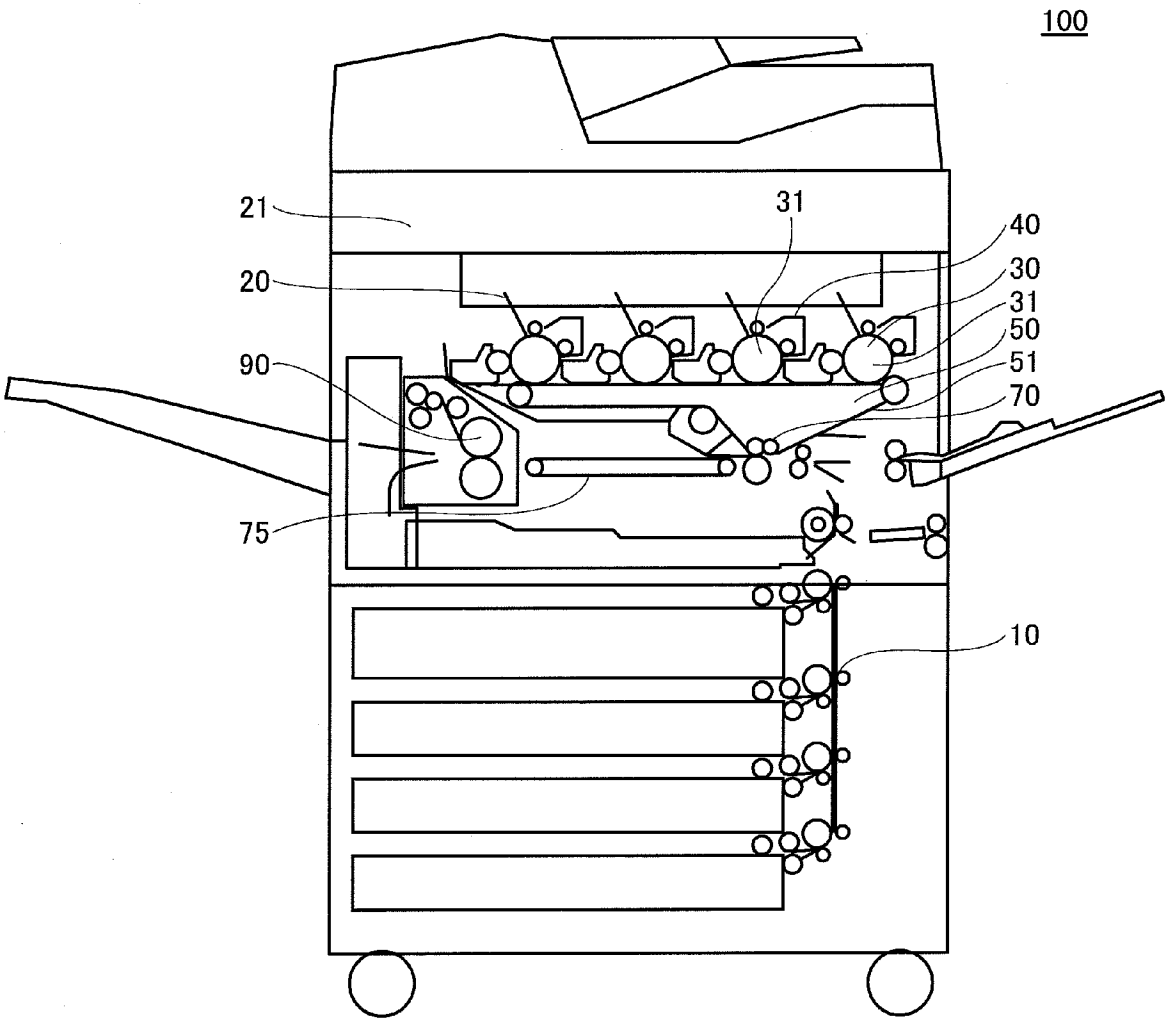
FIG. 1 is a drawing illustrating an exemplary configuration of an image forming apparatus according to a first embodiment.

A first embodiment is described below with reference to the accompanying drawings. FIG. 1 is a drawing illustrating an exemplary configuration of an image forming apparatus 100 according to the first embodiment.

In the image forming apparatus 100, a document is scanned with light by a scanning unit 21 and the light reflected from the document is detected by a 3-line CCD (charge-coupled device) sensor to obtain an image. An image processing unit performs image processing such as scanner gamma correction, color conversion, image separation, and tone correction on the obtained image, and sends the processed image (image data) to an image writing unit 20. The image writing unit 20 modulates signals for driving laser diodes (LD) according to the image data. In a photoconductor unit 30, electrostatic latent images are written on uniformly-charged, rotating photosensitive drums 31 by laser beams emitted from the laser diodes, and the electrostatic latent images are developed by developing units 40 using toner.

The developed images (toner images) on the photosensitive drums 31 are transferred onto an intermediate transfer belt 51 of an intermediate transfer unit 50. Assuming that full-color copying is performed at the image forming apparatus 100, toner images of four colors (black, cyan, magenta, and yellow) are superposed on each other on the intermediate transfer belt 51 to form a combined toner image. After images of all colors are formed and transferred (i.e., after a combined toner image is formed), a sheet medium is fed from a tray 10 in synchronization with the rotation of the intermediate transfer belt 51. The combined toner image is transferred (secondary transfer) by a secondary transfer unit 70 from the intermediate transfer belt 51 to the sheet medium. The sheet medium with the combined toner image is sent via a conveying unit 75 to a fusing unit 90. At the fusing unit 90, the combined toner image is fixed onto the sheet medium by a fusing roller and a pressure roller, and then the sheet medium is ejected. Here, "sheet medium" may indicate, for example, a sheet of paper or any other material.

Figure 2:
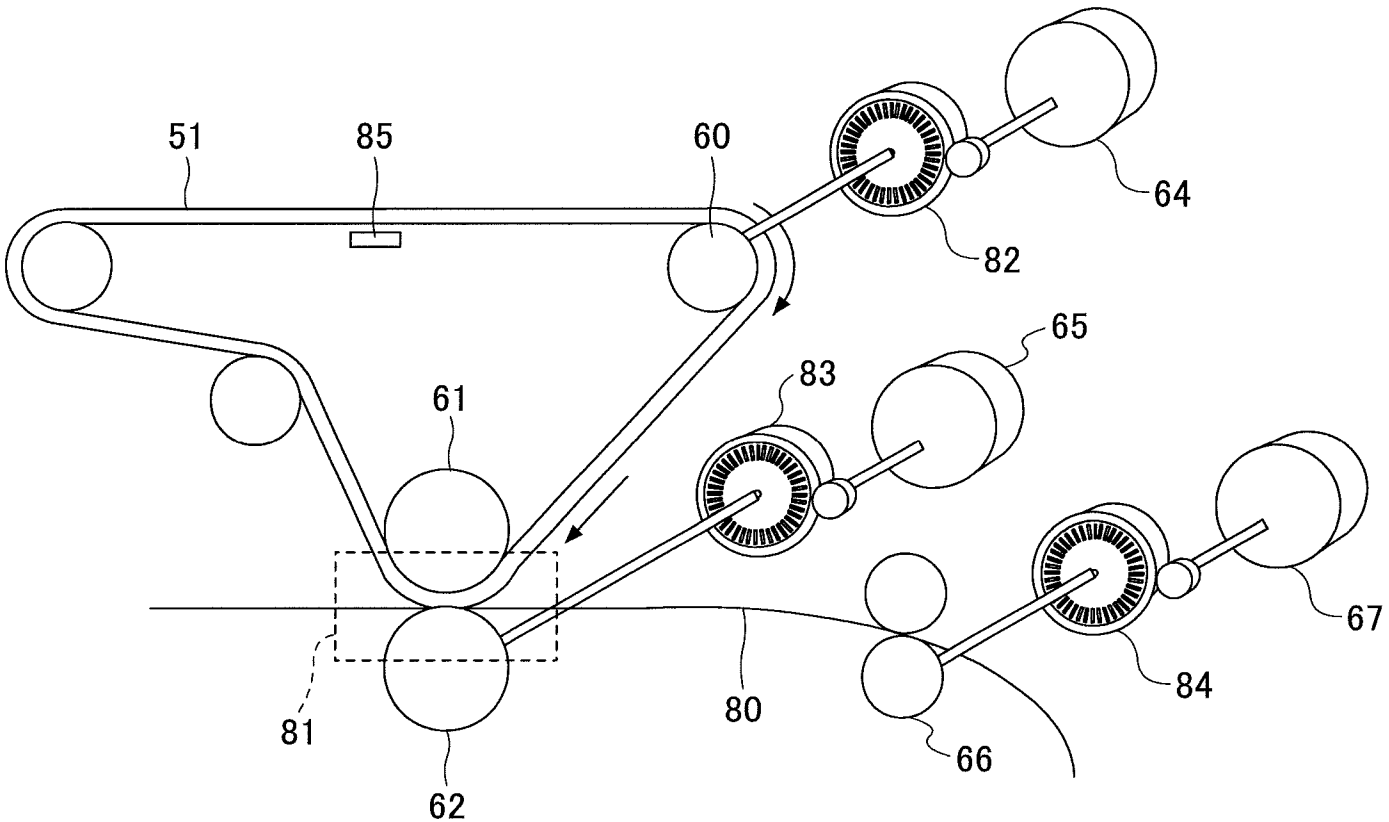
FIG. 2 is a drawing illustrating an exemplary configuration of a mechanism for driving an intermediate transfer belt of an image forming apparatus according to the first embodiment.

FIG. 2 is a drawing illustrating an exemplary configuration of a mechanism for driving the intermediate transfer belt 51 of the image forming apparatus 100. According to the present embodiment, a sheet medium is conveyed by a mechanism as illustrated in FIG. 2. The mechanism illustrated in FIG. 2 and a motor control unit described later may be collectively called a sheet conveying device.

The intermediate transfer belt 51 is rotated by the rotation of an intermediate transfer roller 60 and a repulsive roller 61 to transfer a toner image onto a sheet medium 80.

The intermediate transfer roller 60 is driven by an intermediate transfer motor 64. A reduction mechanism composed of gears is provided between the intermediate transfer motor 64 and the intermediate transfer roller 60. The driving force produced by the intermediate transfer motor 64 is transmitted to the intermediate transfer roller 60 with the motor shaft speed of the intermediate transfer motor 64 reduced by the gear ratio of the reduction mechanism.

A secondary transfer roller 62 is driven by a secondary transfer motor 65. A reduction mechanism is provided between the secondary transfer roller 62 and the secondary transfer motor 65. In the present embodiment, the sheet medium 80 is conveyed by a registration roller 66 to a pressure nip 81 between the repulsive roller 61 and the secondary transfer roller 62, and a toner image is transferred at the pressure nip 81 from the intermediate transfer belt 51 to the sheet medium 80.

The registration roller 66 is positioned immediately before the pressure nip 81 in a conveying path of the sheet medium 80, and is driven by a registration motor 67. A reduction mechanism is provided between the registration roller 66 and the registration motor 67.

An encoder 82 is provided on a shaft of the intermediate transfer roller 60, and an encoder 83 is provided on a shaft of the secondary transfer roller 65. Also, an encoder 84 is provided on a shaft of the registration roller 66. In the image forming apparatus 100 of the present embodiment, the surface speed of the intermediate transfer belt 51 is controlled to match a predetermined target speed based on values detected by the encoders 82 and 83 and a value detected by a sensor that performs belt scale detection for the intermediate transfer belt 51.

In the present embodiment, the intermediate transfer roller 60 may be called a first rotator, the secondary transfer roller 62 may be called a second rotator, and the registration roller 66 may be called a third rotator.

In the image forming apparatus 100 of the present embodiment, the speed of the registration motor 67 for driving the registration roller 66 is controlled based on the driving current of the intermediate transfer roller 60 and the driving current of the secondary transfer roller 62.

Interference among the intermediate transfer belt 51, the secondary transfer roller 62, and the registration roller 66 is described below.

The degree of interference of the registration roller 66 with the intermediate transfer belt 51 and the secondary transfer roller 62 varies depending on, for example, the type of the sheet medium 80 and/or the conveyance speed of the sheet medium 80. For example, when the surface speed of the registration roller 66 is higher than a target speed, the sheet medium 80 is pressed (or pushed) into the pressure nip 81. Accordingly, in this case, the sheet medium 80 influences the rotation of the intermediate transfer belt 51 and the secondary transfer roller 62. The surface speed of the registration roller 66 may become higher than the target speed when, for example, the registration roller 66 expands due to heat.

Meanwhile, when the surface speed of the registration roller 66 is lower than the target speed, the secondary transfer roller 62 and the intermediate transfer belt 51 are pulled via the sheet medium 80 toward the registration roller 66. The surface speed of the registration roller 66 may become lower than the target speed when, for example, the registration roller 66 is cooled and contracts.

An aspect of this disclosure makes it possible to prevent problems resulting from variations in the degree of interference among the registration roller 66, the intermediate transfer belt 51, and the secondary transfer roller 62 caused by expansion and contraction of the registration roller 66. Examples of problems include an unstable control state that is caused when the motor driving current of at least one of the registration motor 67 for driving the registration roller 66, the secondary transfer motor 65 for driving the secondary transfer roller 62, and the intermediate transfer motor 64 for driving the intermediate transfer roller 60 becomes too low, and an overload state where the motor driving current becomes too high.

Figure 3:
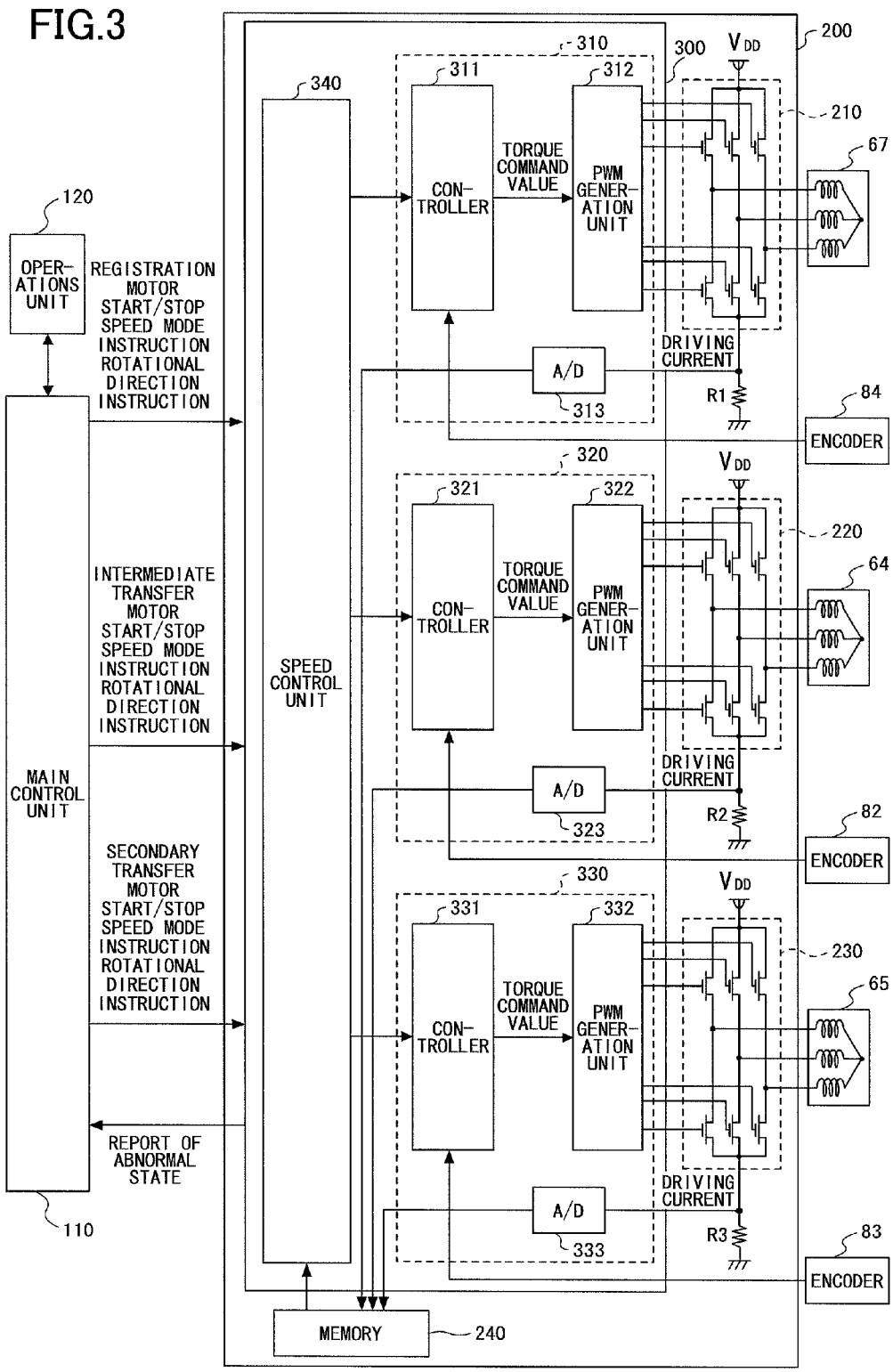
FIG. 3 is a drawing illustrating an exemplary configuration of a motor control unit according the first embodiment.

A motor control unit 200 of the image forming apparatus 100 is described below with reference to FIG. 3. FIG. 3 is a drawing illustrating an exemplary configuration of the motor control unit 200 according the first embodiment.

In the image forming apparatus 100 of the present embodiment, the motor control unit 200 is connected to a main control unit 110 for controlling the entire image forming apparatus 100, and controls the intermediate transfer motor 64, the secondary transfer motor 65, and the registration motor 67. When receiving, for example, a request to output image data from an operations unit 120 of the image forming apparatus 100, the main control unit 110 requests the motor control unit 200 to control the motors. For example, when receiving a request to output image data, the main control unit 110 sends target speed instructions indicating target speeds of the motors to the motor control unit 200. The motor control unit 200 controls the motors based on the target speed instructions.

The motor control unit 200 may include a field-effect transistor (FET) unit 210 for supplying a driving current to the registration motor 67, a FET unit 220 for supplying a driving current to the intermediate transfer motor 64, and a FET unit 230 for supplying a driving current to the secondary transfer motor 65. The motor control unit 200 may also include a motor control CPU (central processing unit) 300 and a memory 240.

The motor control CPU 300 may include a registration motor control unit 310, an intermediate transfer motor control unit 320, a secondary transfer motor control unit 330, and a speed control unit 340.

The registration motor control unit 310 may include a controller 311 and a PWM generation unit 312. The controller 311 inputs a torque command value to the PWM generation unit 312 to control the rotational speed of the registration motor 67, which is detected by the encoder 84, to match the target speed indicated by the target speed instruction sent from the main control unit 110. The PWM generation unit 312 generates a pulse-width modulation (PWM) signal based on the torque command value and sends the generated PWM signal to the FET unit 210. The FET unit 210 supplies a driving current to the registration motor 67 according to the PWM signal.

Also, an analog-to-digital (A/D) converter 313 of the registration motor control unit 310 detects the current value of a current flowing through a shunt resistor R1 connected to the FET unit 210, and stores the detected current value in the memory 240. The current value detected by the A/D converter 313 indicates the driving current supplied to the registration motor 67.

The intermediate transfer motor control unit 320 controls the intermediate transfer motor 64. The intermediate transfer motor control unit 320 may include a controller 321, a PWM generation unit 322, and an A/D converter 323, and perform operations similar to those performed by the registration motor control unit 310. Therefore, descriptions of the operations of the intermediate transfer motor control unit 320 are omitted here.

The secondary transfer motor control unit 330 controls the secondary transfer motor 65. The secondary transfer motor control unit 330 may include a controller 331, a PWM generation unit 332, and an A/D converter 333, and perform operations similar to those performed by the registration motor control unit 310. Therefore, descriptions of the operations of the secondary transfer motor control unit 330 are omitted here.

Thus, according to the present embodiment, control units for controlling three rotators are included in the motor control CPU 300.

Next, the speed control unit 340 of the motor control CPU 300 is described. The speed control unit 340 controls the rotational speed of the registration motor 67 based on the driving current (hereafter referred to as an intermediate transfer driving current) of the intermediate transfer motor 64 and the driving current (hereafter referred to as a secondary transfer driving current) of the secondary transfer motor 65. For example, when the sum of the intermediate transfer driving current and the secondary transfer driving current (i.e., the sum of the corresponding values stored in the memory 240) deviates from a predetermined range, the speed control unit 340 requests the controller 311 to change the rotational speed of the registration motor 67 based on the sum of the driving currents. The intermediate transfer driving current may also be referred to as a first control factor, the secondary transfer driving current may also be referred to as a second control factor, and the driving current of the registration motor 67 may be referred to as a third control factor.

"Requests" made by the speed control unit 340 of the present embodiment may include instructions (or commands) to rewrite values used by the registration motor control unit 310, the intermediate transfer motor control unit 320, and the secondary transfer motor control unit 330, and instructions (or commands) to control the rotational speed of the motors corresponding to the control units 310, 320, and 330.

The predetermined range of the sum of the intermediate transfer driving current and the secondary transfer driving current according to the present embodiment is described below.

Figure 4:
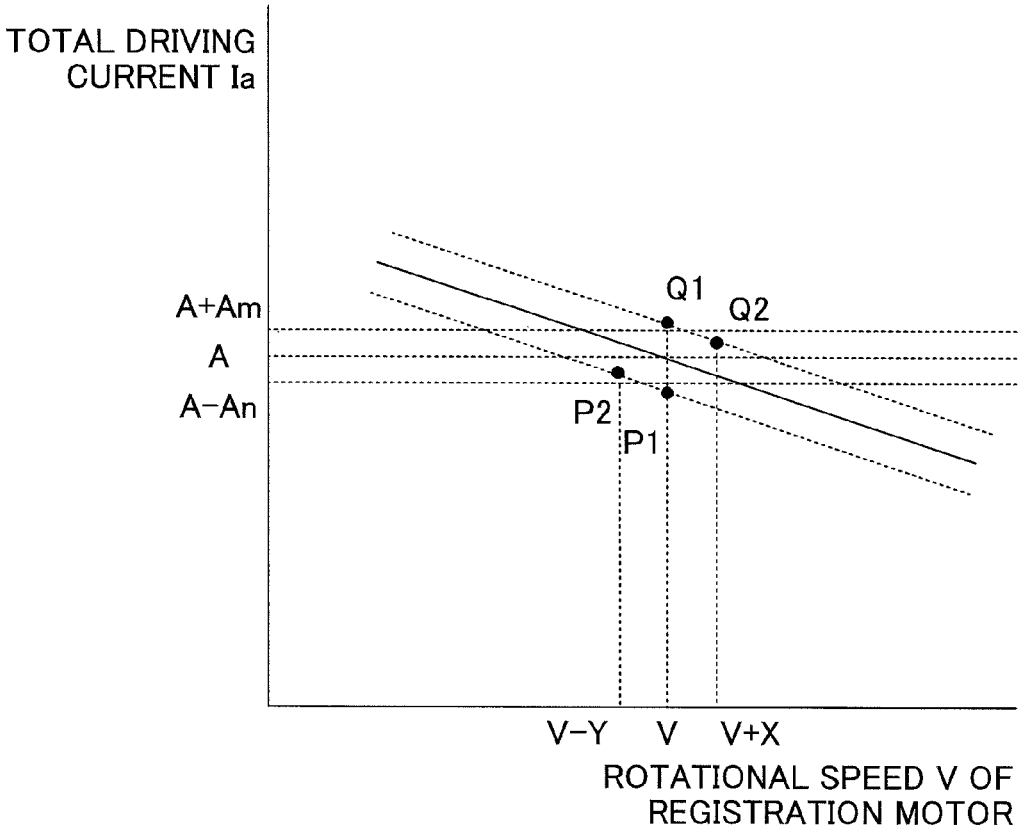
FIG. 4 is a graph illustrating a relationship between the sum of driving currents and the rotational speed of a registration motor according to the first embodiment.

FIG. 4 is a graph illustrating a relationship between the sum of driving currents and the rotational speed of the registration motor 67 according to the first embodiment.

In FIG. 4, the vertical axis indicates the sum of the intermediate transfer driving current and the secondary transfer driving current (hereafter referred to as a total driving current), and the horizontal axis indicates the rotational speed of the registration motor 67.

In the descriptions below, V indicates the rotational speed of the registration motor 67 when the registration roller 66 is not expanded and contracted, and Ia indicates the total driving current. The rotational speed V is a target rotational speed (third target rotational speed) of the registration motor 67. When the registration motor 67 is at the target rotational speed V, the total driving current Ia is the sum of the intermediate transfer driving current obtained when the intermediate transfer motor 64 is at a target rotational speed (first target rotational speed) and the secondary transfer driving current obtained when the secondary transfer motor 65 is at a target rotational speed (second target rotational speed).

Although the degree of interference of the registration roller 66 may vary depending on, for example, the type of the sheet medium 80 and/or the conveyance speed of the sheet medium 80, the rotational speed V of the registration motor 67 and the total driving current Ia generally have a relationship as illustrated in FIG. 4.

For example, when the registration roller 66 expands and its surface speed increases, the intermediate transfer belt 51 and the secondary transfer roller 62 are pressed forward via the sheet medium 80, the load of the secondary transfer roller 62 is reduced, and therefore the total driving current Ia decreases. In this case, the relationship between the total driving current Ia and the rotational speed V of the registration motor 67 is represented by a line that passes through points P1 and P2.

Meanwhile, when the registration roller 66 contracts and its surface speed decreases, the intermediate transfer belt 51 and the secondary transfer roller 62 are pulled backward via the sheet medium 80, the load of the secondary transfer roller 62 increases, and therefore the total driving current Ia increases. In this case, the relationship between the total driving current Ia and the rotational speed V of the registration motor 67 is represented by a line that passes through points Q1 and Q2.

In the present embodiment, the rotational speed V of the registration motor 67 is controlled based on the variation of the total driving current Ia in view of the relationship between the rotational speed V and the total driving current Ia. For example, when the total driving current Ia becomes greater than or equal to a first threshold (A+Am) or when the total driving current Ia becomes less than or equal to a second threshold (A−An), the rotational speed V of the registration motor 67 is controlled such that the total driving current Ia falls within a range indicated by $(A-An)<A<(A+Am)$.

The first threshold (A+Am) and the second threshold (A−An) are described below. In the present embodiment, values Am and An are determined in advance, based on experiments and evaluations, and stored in the speed control unit 340. A value A indicates the total driving current Ia obtained when the registration roller 66 is not expanded and contracted. In other words, the value A is the sum of the intermediate transfer driving current obtained when the intermediate transfer motor 64 is rotating at the target rotational speed and the secondary transfer driving current obtained when the secondary transfer motor 65 is rotating at the target rotational speed. The value A is used as a reference value when detecting the variation of the total driving current Ia.

The value Am indicates the maximum allowable increase in the driving current of the secondary transfer motor 65 resulting from an increase in the load of the secondary transfer roller 62. In the present embodiment, the value Am is obtained, for example, as described below. In an evaluation experiment of the motor control unit 200, the rotational speed of the secondary transfer roller 62 is gradually increased while measuring a current flowing through a driving element such as the FET unit 230. Then, the reference value A is subtracted from the total driving current Ia measured when the current flowing through the driving element reaches about 80% of the rated current of the driving element, and the resulting value is used as the value Am.

With the first threshold (A+Am) set as described above, it is possible to prevent damage to the driving element due to the increase in the driving current of the secondary transfer motor 65.

The value An indicates the maximum allowable decrease in the driving current of the secondary transfer motor 65 resulting from a decrease in the load of the secondary transfer roller 62. In the present embodiment, the value An is obtained, for example, as described below. An experiment is conducted to monitor the driving current of the secondary transfer motor 65 while reducing the load of the secondary transfer motor 65 by changing the torque command value for the secondary transfer motor 65. When the load is gradually reduced, the driving current of the secondary transfer motor 65 eventually enters a dead zone and the secondary transfer motor 65 enters an uncontrollable state. A value is obtained by subtracting the reference value A from the total driving current Ia measured slightly before the driving current of the secondary transfer motor 65 enters the dead zone, and the absolute value of the obtained value is used as the value An. Alternatively, the reference value A may be subtracted from a value that is slightly greater than the total driving current Ia measured just when the driving current of the secondary transfer motor 65 enters the dead zone to obtain the value An. Thus, with the second threshold (A−An), which indicates a current value that is slightly greater than the total driving current Ia measured when the driving current of the secondary transfer motor 65 enters the dead zone, it is possible to prevent the secondary transfer motor 65 from entering an uncontrollable state.

As described above, in the present embodiment, the first threshold (A+Am) and the second threshold (A−An) are determined based on the driving current of the secondary transfer motor 65. However, the first threshold (A+Am) and the second threshold (A−An) may instead be obtained based on the driving current of the intermediate transfer motor 64. Since the status of the intermediate transfer motor 64 and the status of the secondary transfer motor 65 are relative to each other, the first and second thresholds may be determined based on the driving current of one of the motors 64 and 65.

In the present embodiment, when the total driving current Ia exceeds the first threshold (A+Am), the speed control unit 340 determines that the rotational speed of the registration motor 67 has decreased and requests the controller 311 to increase the rotational speed of the registration motor 67. Meanwhile, when the total driving current Ia becomes less than the second threshold (A−An), the speed control unit 340 determines that the rotational speed of the registration motor 67 has increased and requests the controller 311 to decrease the rotational speed of the registration motor 67.

Figure 5:
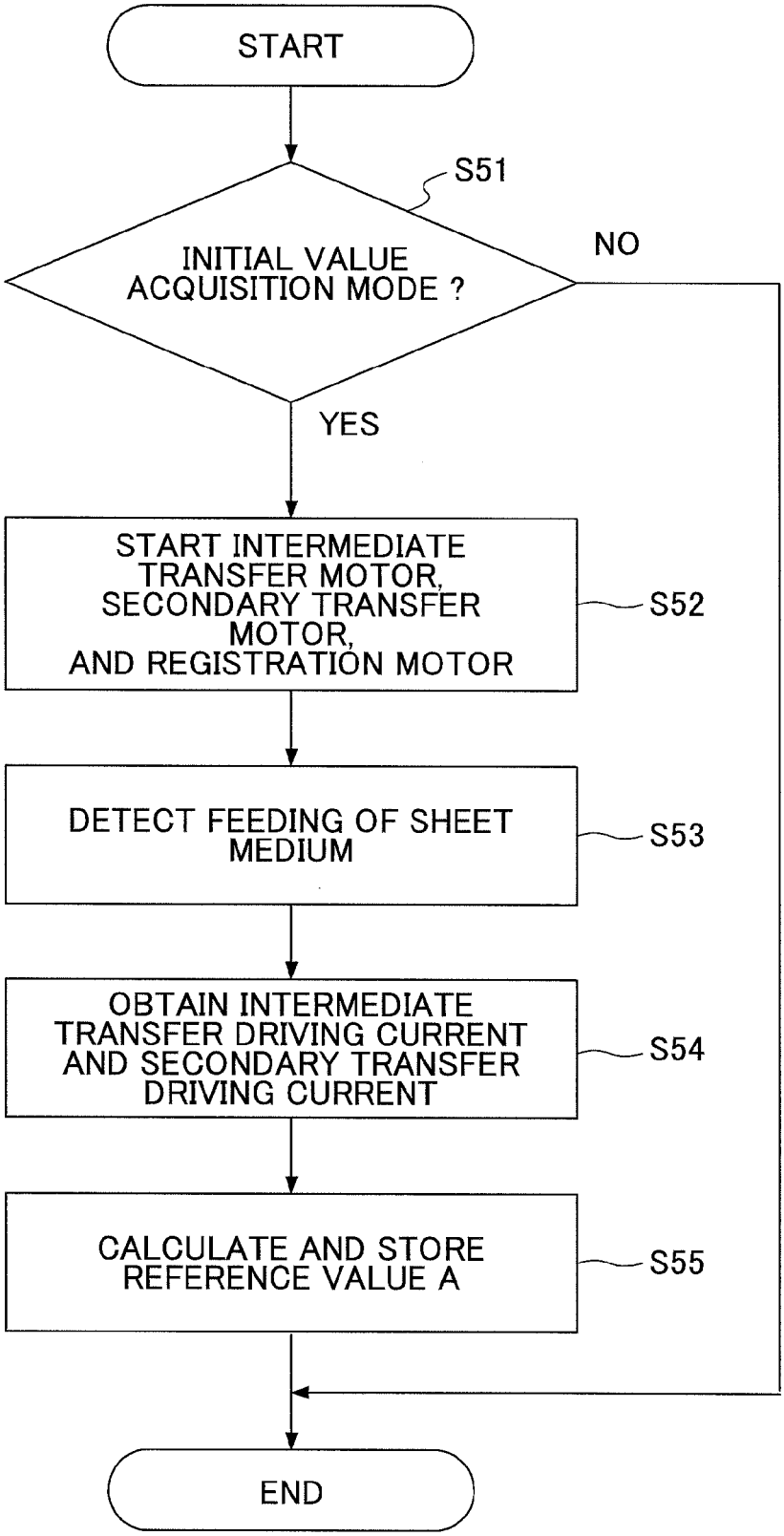
FIG. 5 is a flowchart illustrating an exemplary process performed by a motor control unit of the first embodiment to calculate a reference value.

An exemplary process of calculating the reference value A by the motor control unit 200 of the present embodiment is described below with reference to FIG. 5. FIG. 5 is a flowchart illustrating an exemplary process performed by the motor control unit 200 of the first embodiment to calculate the reference value A.

The motor control unit 200 determines whether an instruction received from the main control unit 110 indicates an initial value acquisition mode (step S51). The initial value acquisition mode indicates that the image forming apparatus 100 is in an initial state. The image forming apparatus 100 is in the initial state when, for example, it has just been manufactured or its maintenance has just been completed.

When it is determined in step S51 that the instruction indicates the initial value acquisition mode, the registration motor control unit 310, the intermediate transfer motor control unit 320, and the secondary transfer motor control unit 330 of the motor control unit 200 start the registration motor 67, the intermediate transfer motor 64, and the secondary transfer motor 65 (step S52). Next, the motor control unit 200 detects feeding of the sheet medium 80 (step S53). Here, feeding of the sheet medium 80 is detected when the sheet medium is conveyed from the registration roller 66 to the secondary transfer roller 62. For example, feeding of the sheet medium 80 may be detected using a sensor (not shown).

The motor control unit 200 obtains values of an intermediate transfer driving current for driving the intermediate transfer motor 64 and a secondary transfer driving current for driving the secondary transfer motor 65, and stores the obtained values in the memory 240 (step S54). More specifically, the value of the intermediate transfer driving current is detected and stored in the memory 240 by a shunt resistor R2 and an A/D converter 323. Similarly, the value of the secondary transfer driving current is detected and stored in the memory 240 by a shunt resistor R3 and an A/D converter 333.

Then, the speed control unit 340 of the motor control unit 200 calculates the sum of the values of the intermediate transfer driving current and the secondary transfer driving current stored in the memory 240 as the reference value A, and stores the reference value A in the memory 240 (step S55).

The motor control unit 200 may be configured to obtain multiple sets of values of the intermediate transfer driving current and the secondary transfer driving current at predetermined intervals during a time period including the timing when the sheet medium 80 passes through the secondary transfer roller 62, and to calculate an average of the sums of the obtained values as the reference value A. For example, the motor control unit 200 may be configured to obtain the sum of the values of the intermediate transfer driving current and the secondary transfer driving current at 10-ms intervals for one thousand times, and to calculate an average of the obtained sums as the reference value A.

Figure 6:
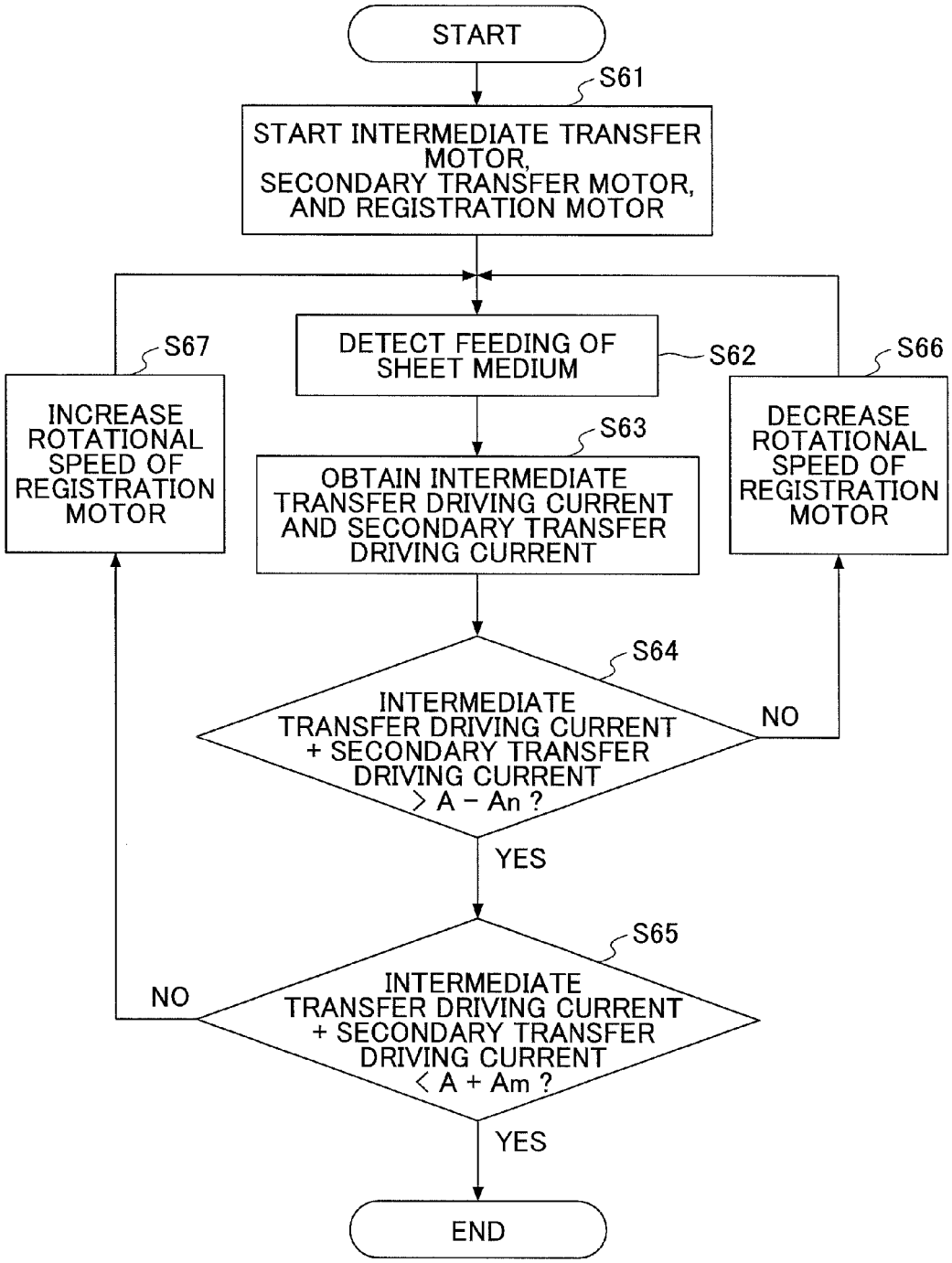
FIG. 6 is a flowchart illustrating an exemplary process performed by a speed control unit of the first embodiment.

Next, an exemplary process performed by the speed control unit 340 is described with reference to FIG. 6. FIG. 6 is a flowchart illustrating an exemplary process performed by the speed control unit 340 of the first embodiment.

Steps S61 through S63 of FIG. 6 are substantially the same as steps S52 through S54 of FIG. 5, and therefore their descriptions are omitted here.

Following step S63, the speed control unit 340 calculates the second threshold (A−An) based on the reference value A stored in the memory 240 and the value An, and determines whether the total driving current Ia obtained by adding the intermediate transfer driving current and the secondary transfer driving current is greater than the second threshold (A−An) (step S64). When the total driving current Ia is greater than the second threshold (A−An) in step S64, the speed control unit 340 proceeds to step S65.

The speed control unit 340 calculates the first threshold (A+Am) based on the reference value A stored in the memory 240 and the value Am, and determines whether the total driving current Ia obtained by adding the intermediate transfer driving current and the secondary transfer driving current is less than the first threshold (A+Am) (step S65).

When the total driving current Ia is less than the first threshold (A+Am) in step S65, the speed control unit 340 terminates the process.

Meanwhile, when the total driving current Ia is less than or equal to the second threshold (A−An) in step S64, the speed control unit 340 requests the controller 311 of the registration motor control unit 310 to decrease the rotational speed V of the registration motor 67 (step S66).

The controller 311 includes a counter (not shown) that counts the number of pulses output from the encoder 84. For example, the speed control unit 340 may be configured to refer to the count of the counter and request the controller 311 to decrease the count (e.g., by a predetermined value or amount) and thereby decrease the rotational speed V of the registration motor 67. In this case, the controller 311 generates a torque command value based on the decreased count and outputs the torque command value to the PWM generation unit 312.

After the speed control unit 340 requests the controller 311 to decrease the rotational speed V of the registration motor 67 in step S66, the motor control unit 200 returns to step S62. Thus, in the present embodiment, step S66 is repeated until the total driving current Ia becomes greater than the second threshold (A−An) in step S64.

For example, when the rotational speed V of the registration motor 67 is decreased by "Y", the total driving current Ia increases and the condition of step S64 is satisfied as indicated by the point P2 of FIG. 4.

When the total driving current Ia is greater than or equal to the first threshold (A+Am) in step S65, the speed control unit 340 requests the controller 311 of the registration motor control unit 310 to increase the rotational speed V of the registration motor 67 (step S67). More specifically, the speed control unit 340 refers to the count of the counter of the controller 311 and requests the controller 311 to increase the count (e.g., by a predetermined value or amount) and thereby increase the rotational speed V of the registration motor 67. In this case, the controller 311 generates a torque command value based on the increased count and outputs the torque command value to the PWM generation unit 312.

After the speed control unit 340 requests the controller 311 to increase the rotational speed V of the registration motor 67 in step S67, the motor control unit 200 returns to step S62. Thus, in the present embodiment, step S67 is repeated until the total driving current Ia becomes less than the first threshold (A+Am) in step S65.

For example, when the rotational speed V of the registration motor 67 is increased by "X", the total driving current Ia decreases and the condition of step S65 is satisfied as indicated by the point Q2 of FIG. 4.

The value (either a decrement or an increment) by which the count is decreased and increased in steps S66 and S67 may be determined in advance. For example, the value may be determined such that the resulting change in the rotational speed V does not influence normal paper feeding and/or the image quality.

The image forming apparatus 100 may be configured to perform the process of FIG. 6 each time the number of pages on which images are formed reaches a predetermined value.

As described above, in the present embodiment, the rotational speed V of the registration motor 67 is controlled based on the variation of the total driving current Ia in view of the relationship between the rotational speed V and the total driving current Ia. The configuration of the present embodiment makes it possible to keep the variation of the total driving current Ia in a predetermined range. This in turn makes it possible to properly control the rotation of three or more rotators such as the intermediate transfer roller 60, the secondary transfer roller 62, and the registration roller 66, and thereby makes it possible to reduce the interference among the rotators.

In the present embodiment, the registration motor control unit 310, the intermediate transfer motor control unit 320, and the secondary transfer motor control unit 330 are provided in the same motor control CPU 300. This configuration makes it possible to quickly control the rotational speed of a third rotator based on the driving currents of first and second rotators, and thereby makes it possible to control the rotation of the first through third rotators and reduce the interference among the first through third rotators.

<Second Embodiment>

A second embodiment is described below with reference to the accompanying drawings. The second embodiment is different from the first embodiment in that torque command values are used instead of the driving currents of the intermediate transfer motor 64 and the secondary transfer motor 62. Below, differences from the first embodiment are mainly described. The same reference numbers are assigned to components corresponding to those in the first embodiment, and their descriptions are omitted.

Figure 7:
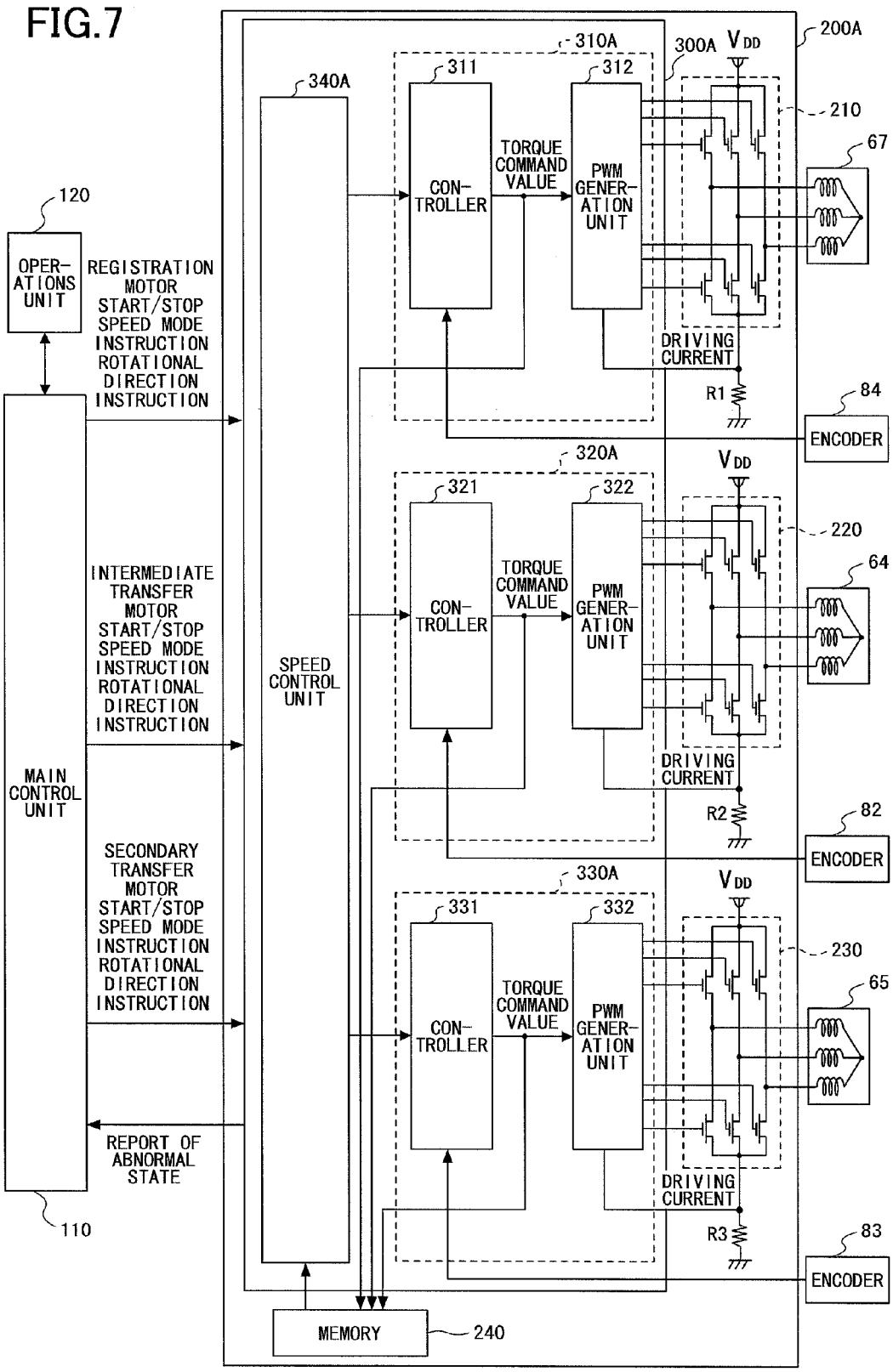
FIG. 7 is a drawing illustrating an exemplary configuration of a motor control unit according a second embodiment.

FIG. 7 is a drawing illustrating an exemplary configuration of a motor control unit 200A according the second embodiment.

The motor control unit 200A may include a motor control CPU 300A. The motor control CPU 300A may include a registration motor control unit 310A, an intermediate transfer motor control unit 320A, a secondary transfer motor control unit 330A, and a speed control unit 340A.

The registration motor control unit 310A may include a controller 311 and a PWM generation unit 312. In the second embodiment, a torque command value output from the controller 311 to the PWM generation unit 312 is stored in a memory 240. Configurations of the intermediate transfer motor control unit 320A and the secondary transfer motor control unit 330A are substantially the same as the configuration of the registration motor control unit 310A.

The speed control unit 340A requests the controller 311 to change the rotational speed V of the registration motor 67 based on torque command values stored in the memory 240.

Figure 8:
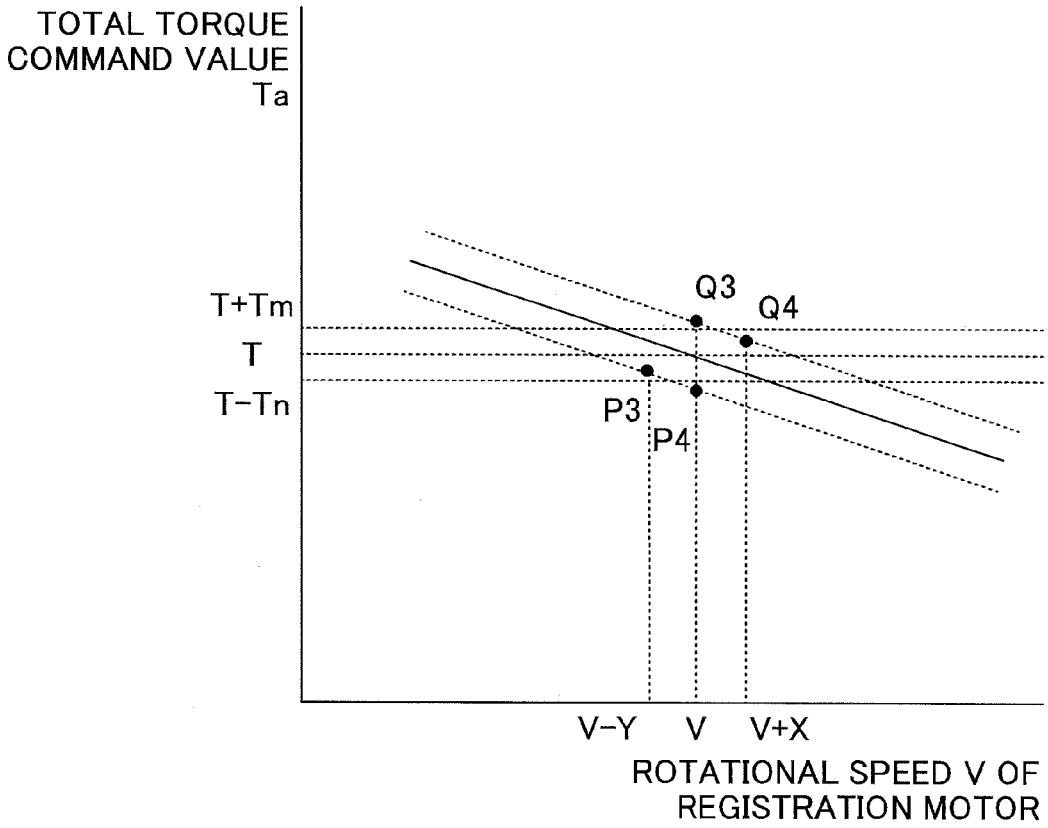
FIG. 8 is a graph illustrating a relationship between the sum of torque command values and the rotational speed of a registration motor according to the second embodiment.

FIG. 8 is a graph illustrating a relationship between the sum of torque command values and the rotational speed of the registration motor 67 according to the second embodiment.

In FIG. 8, the vertical axis indicates the sum of a torque command value of the intermediate transfer motor 64 and a torque command value of the secondary transfer motor 65 (hereafter referred to as a total torque command value), and the horizontal axis indicates the rotational speed of the registration motor 67.

In the descriptions below, V indicates the rotational speed of the registration motor 67 when the registration roller 66 is not expanded and contracted, and Ta indicates the total torque command value.

In FIG. 8, the total torque command value Ta is at a value T when the total driving current Ia is at the reference value A. The value T is used as a reference value for controlling the rotational speed V of the registration motor 67. A first threshold (T+Tm) indicates the total torque command value Ta used when the total driving current Ia is at (A+Am), and a second threshold (T−Tn) indicates the total torque command value Ta used when the total driving current Ia is at (A−An).

Figure 9:
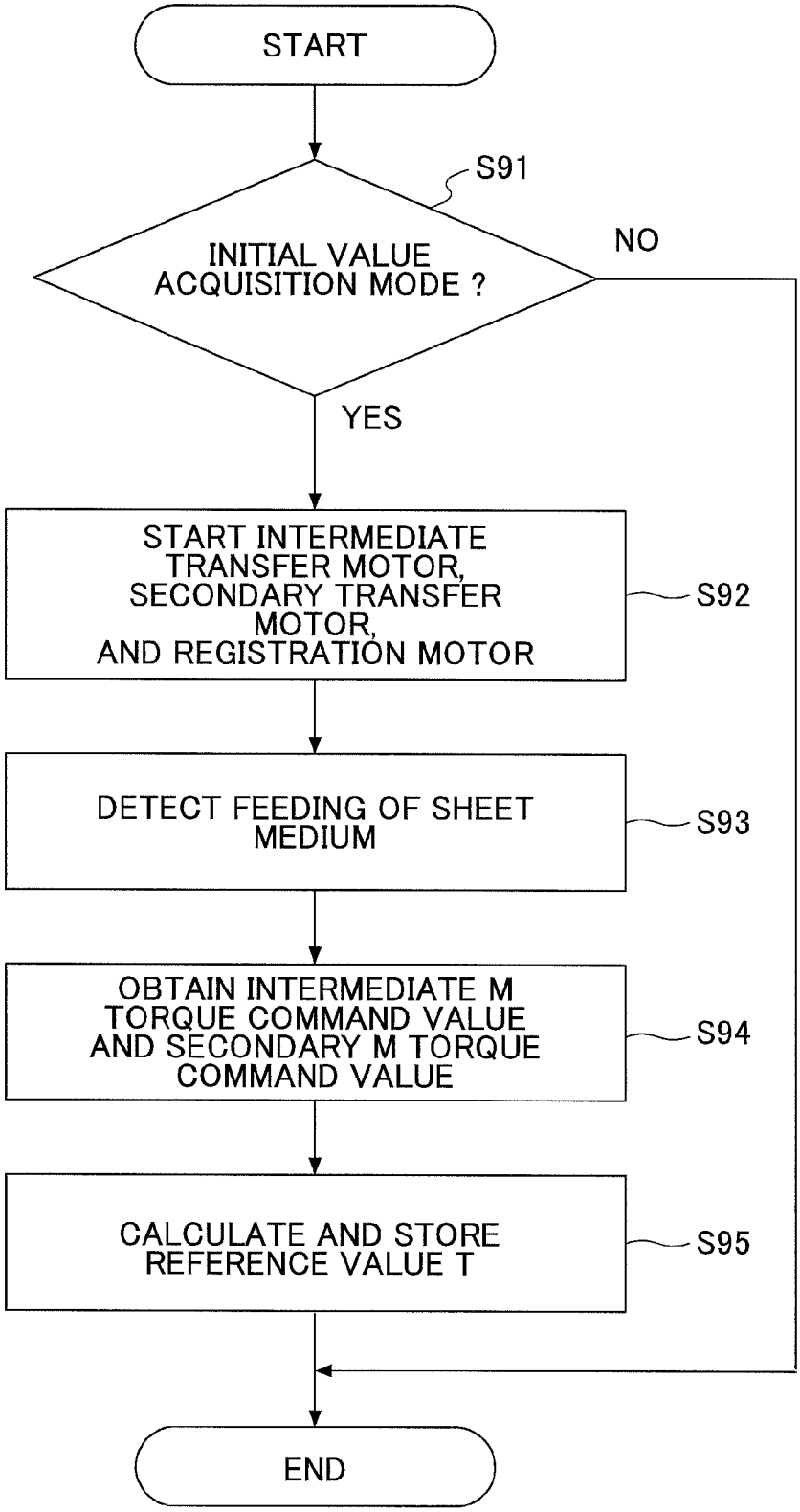
FIG. 9 is a flowchart illustrating an exemplary process performed by a motor control unit of the second embodiment to calculate a reference value.

An exemplary process of calculating the reference value T by the motor control unit 200A of the second embodiment is described below with reference to FIG. 9. FIG. 9 is a flowchart illustrating an exemplary process performed by the motor control unit 200A of the second embodiment to calculate the reference value T.

Steps S91 through S93 of FIG. 9 are substantially the same as steps S51 through S53 of FIG. 5, and therefore their descriptions are omitted here.

Following step S93, the motor control unit 200A obtains an intermediate M torque command value for the intermediate transfer motor 64 and a secondary M torque command value for the secondary transfer motor 65, and stores the obtained values in the memory 240 (step S94). More specifically, the controller 321 outputs the intermediate M torque command value to the PWM generation unit 322 and also stores the intermediate M torque command value in the memory 240. Similarly, the controller 331 outputs the secondary M torque command value to the PWM generation unit 332 and also stores the secondary M torque command value in the memory 240. The intermediate M torque command value may also be referred to as a first control factor, the secondary M torque command value may also be referred to as a second control factor, and the torque command value for the registration motor 67 may be referred to as a third control factor.

Next, the speed control unit 340A of the motor control unit 200A calculates the sum of the intermediate M torque command value and the secondary M torque command value stored in the memory 240 as the reference value T, and stores the reference value T in the memory 240 (step S95).

Figure 10:
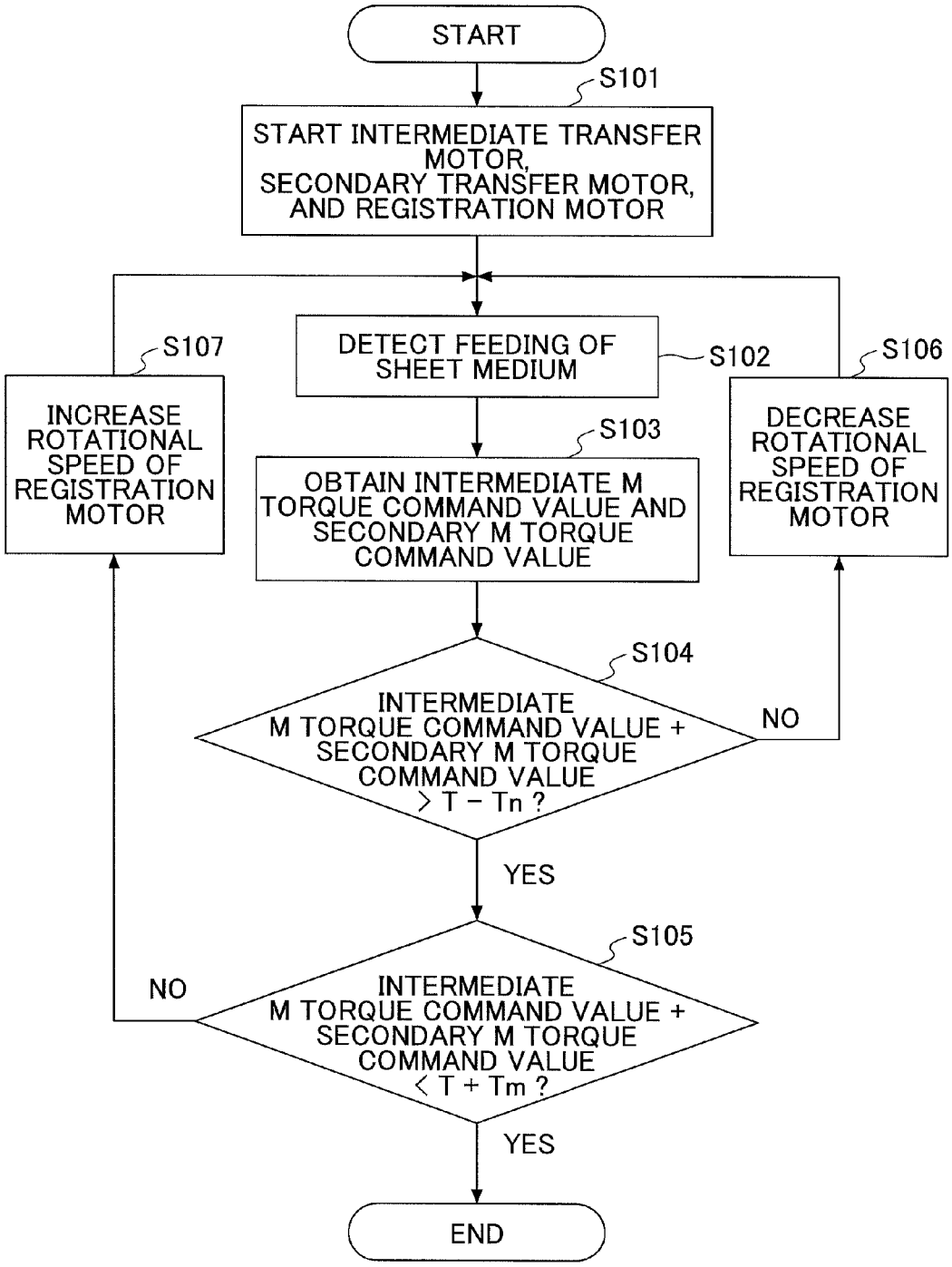
FIG. 10 is a flowchart illustrating an exemplary process performed by a speed control unit of the second embodiment.

Next, an exemplary process performed by the speed control unit 340A is described with reference to FIG. 10. FIG. 10 is a flowchart illustrating an exemplary process performed by the speed control unit 340A of the second embodiment. Steps S101 through S103 of FIG. 10 are substantially the same as steps S92 through S94 of FIG. 9, and therefore their descriptions are omitted here.

Following step S103, the speed control unit 340A calculates the second threshold (T−Tn) based on the reference value T stored in the memory 240 and the value Tn, and determines whether the total torque command value Ta obtained by adding the intermediate M torque command value and the secondary M torque command value is greater than the second threshold (T−Tn) (step S104). When the total torque command value Ta is greater than the second threshold (T−Tn) in step S104, the speed control unit 340A proceeds to step S105.

Next, the speed control unit 340A calculates the first threshold (T+Tm) based on the reference value T stored in the memory 240 and the value Tm, and determines whether the total torque command value Ta obtained by adding the intermediate M torque command value and the secondary M torque command value is less than the first threshold (T+Tm) (step S105).

When the total torque command value Ta is less than the first threshold (T+Tm) in step S105, the speed control unit 340A terminates the process.

Meanwhile, when the total torque command value Ta is less than or equal to the second threshold (T−Tn) in step S104, the speed control unit 340A requests the controller 311 of the registration motor control unit 310A to decrease the rotational speed V of the registration motor 67 (step S106).

When the total torque command value Ta is greater than or equal to the first threshold (T+Tm) in step S105, the speed control unit 340A requests the controller 311 of the registration motor control unit 310A to increase the rotational speed V of the registration motor 67 (step S107).

With the above configuration, the second embodiment provides substantially the same advantages as those of the first embodiment.

<Third Embodiment>

A third embodiment is described below with reference to the accompanying drawings. The third embodiment is different from the first embodiment in that the rotational speed of the registration motor 67 is changed based on a current value obtained by subtracting the driving current of the registration motor 67 from the total driving current Ia. Below, differences from the first embodiment are mainly described. The same reference numbers are assigned to components corresponding to those in the first embodiment, and their descriptions are omitted.

Figure 11:
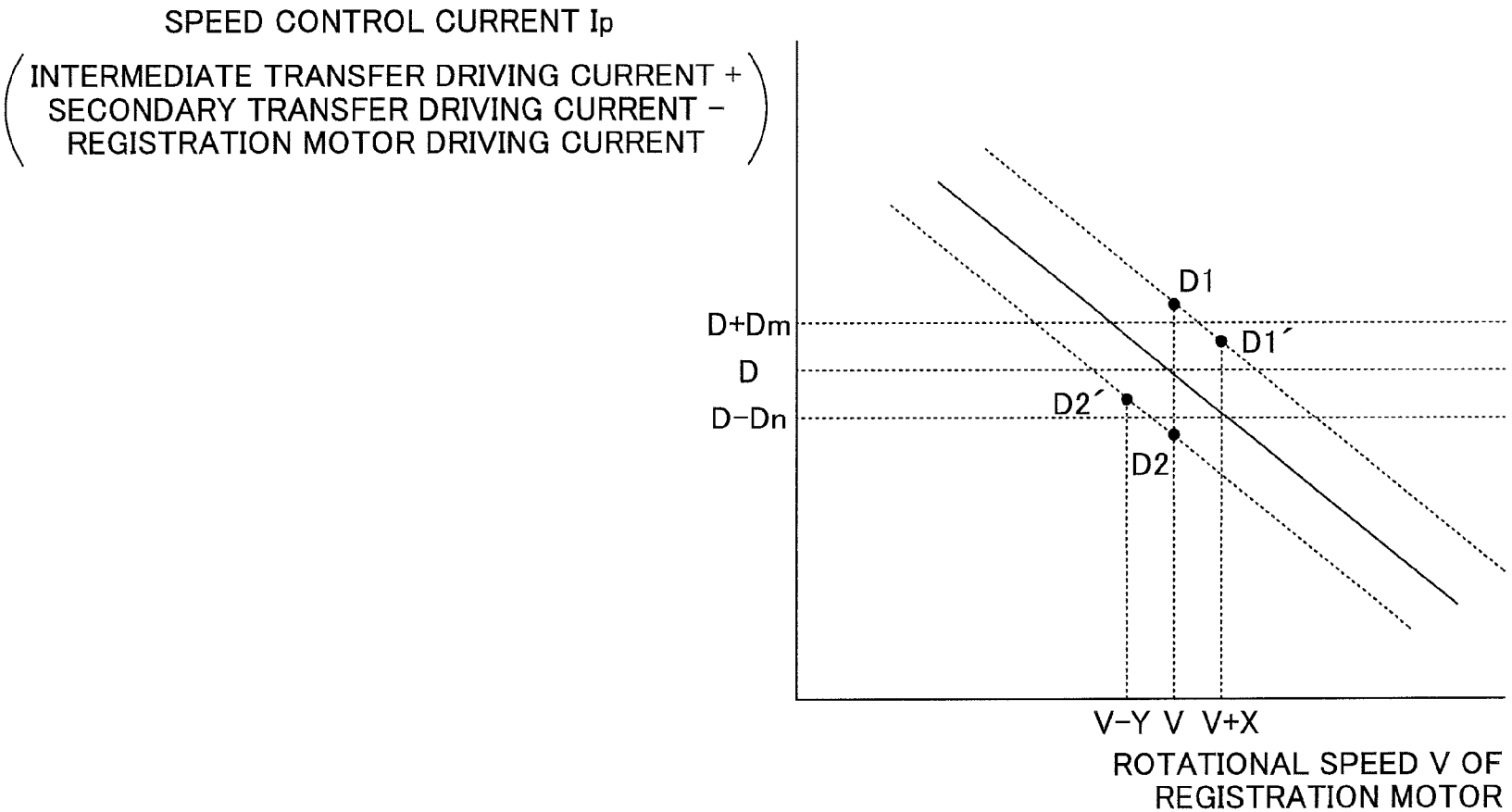
FIG. 11 is a graph illustrating a relationship between a speed control current and the rotational speed of a registration motor according to a third embodiment.

FIG. 11 is a graph illustrating a relationship between a speed control current and the rotational speed of the registration motor 67 according to the third embodiment.

In FIG. 11, the vertical axis indicates a speed control current Ip obtained by subtracting the driving current of the registration motor 67 from the sum of the intermediate transfer driving current and the secondary transfer driving current (i.e., the total driving current Ia).

The slope of a line indicating the relationship between the speed control current Ip and the rotational speed V of the registration motor 67 is greater than the slope of a line indicating the relationship between the total driving current Ia and the rotational speed V.

For example, when the variation of the total driving current Ia is moderate with respect to the variation of the rotational speed of the registration motor 67, it may be difficult to determine whether to change the rotational speed of the registration motor 67 based on a small change in the total driving current Ia.

For this reason, in the third embodiment, the speed control current Ip obtained by subtracting the driving current of the registration motor 67 from the total driving current Ia is used to increase the slope of a line indicating the relationship between the speed control current Ip and the rotational speed V. This configuration makes it possible to determine whether to change the rotational speed of the registration motor 67 based even on a small change in the total driving current Ia.

Figure 12:
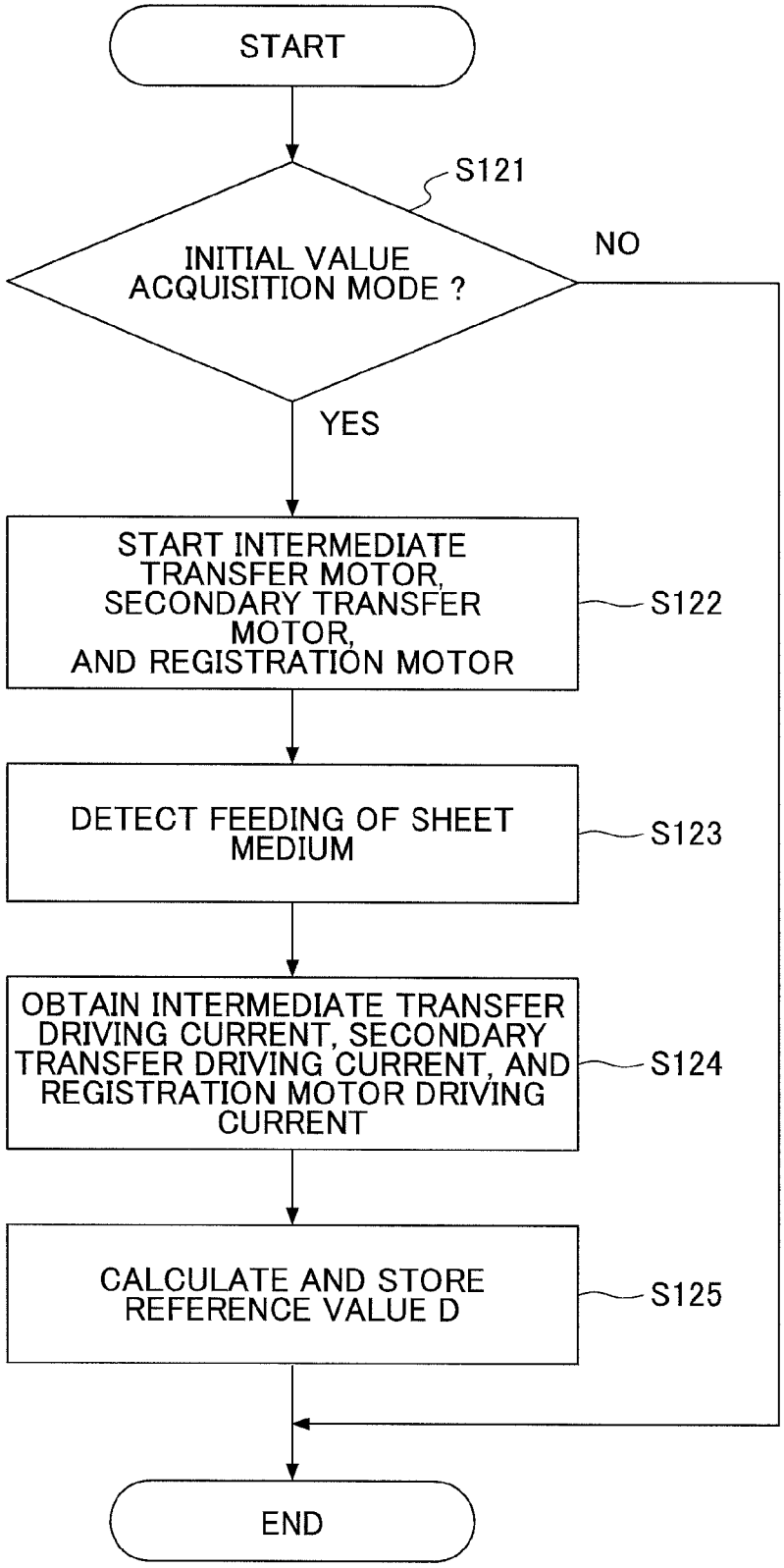
FIG. 12 is a flowchart illustrating an exemplary process performed by a motor control unit of the first embodiment to calculate a reference value.

An exemplary process of calculating a reference value D by the motor control unit 200 of the third embodiment is described below with reference to FIG. 12. FIG. 12 is a flowchart illustrating an exemplary process performed by the motor control unit 200 of the third embodiment to calculate the reference value D.

Steps S121 through S123 of FIG. 12 are substantially the same as steps S51 through S53 of FIG. 5, and therefore their descriptions are omitted here.

Following step S123, the motor control unit 200 obtains values of the intermediate transfer driving current, the secondary transfer driving current, and the driving current of the registration motor 67, and stores the obtained values in the memory 240 (step S124). Then, the speed control unit 340 of the motor control unit 200 calculates the sum of the values of the intermediate transfer driving current and the secondary transfer driving current stored in the memory 240 and subtracts the value of the driving current of the registration motor 67 from the calculated sum to obtain the reference value D, and stores the reference value D in the memory 240 (step S125).

Figure 13:
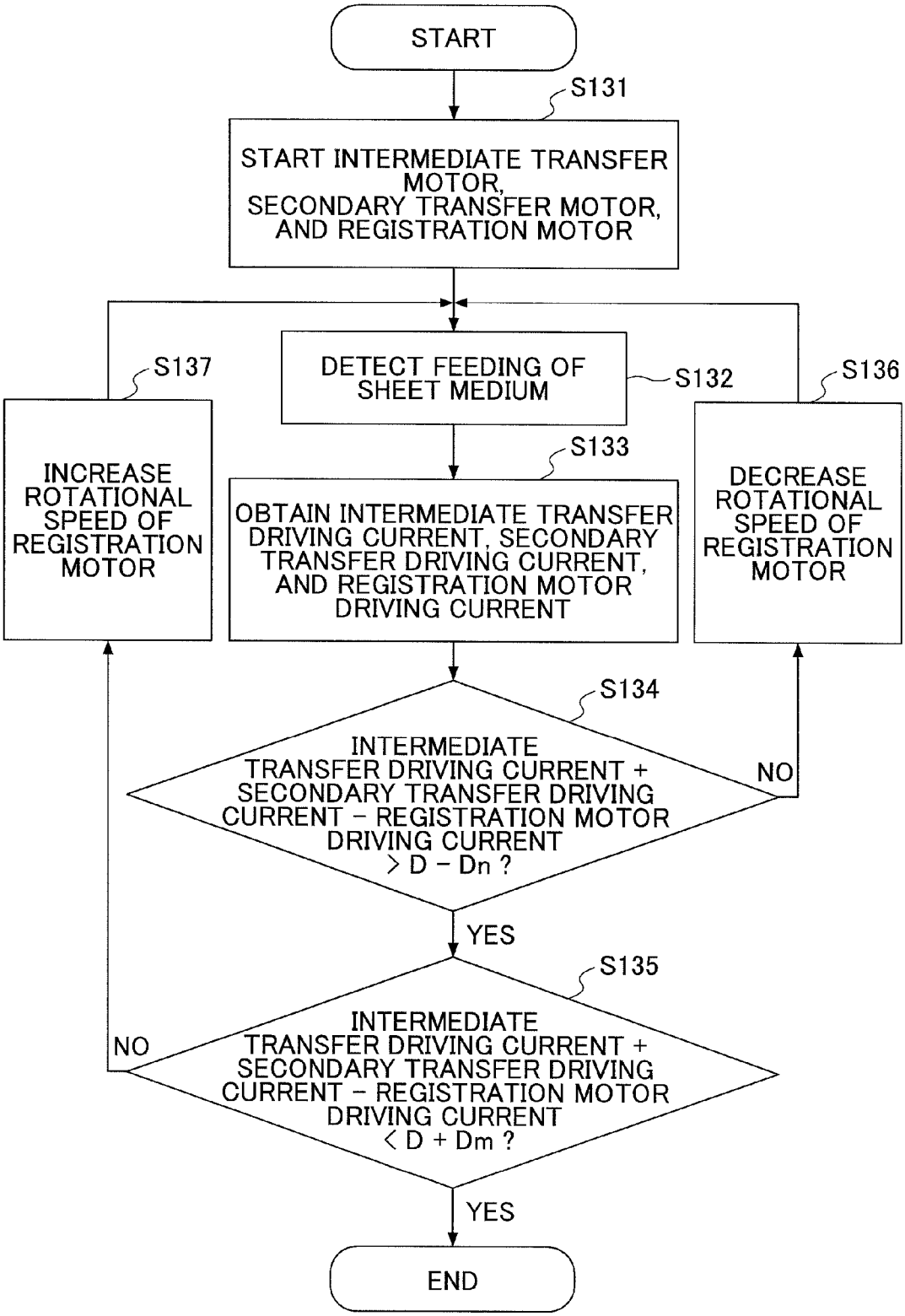
FIG. 13 is a flowchart illustrating an exemplary process performed by a speed control unit of the third embodiment.

Next, an exemplary process performed by the speed control unit 340 of the third embodiment is described with reference to FIG. 13. FIG. 13 is a flowchart illustrating an exemplary process performed by the speed control unit 340 of the third embodiment.

Steps S131 through S133 of FIG. 13 are substantially the same as steps S122 through S124 of FIG. 12, and therefore their descriptions are omitted here.

Following step S133, the speed control unit 340 calculates a second threshold (D−Dn) based on the reference value D stored in the memory 240 and a value Dn, and determines whether the speed control current Ip is greater than the second threshold (D−Dn) (step S134). When the speed control current Ip is greater than the second threshold (D−Dn) in step S134, the speed control unit 340 proceeds to step S135.

Next, the speed control unit 340 calculates a first threshold (D+Dm) based on the reference value D stored in the memory 240 and a value Dm, and determines whether the speed control current Ip is less than the first threshold (D+Dm) (step S135).

When the speed control current Ip is less than the first threshold (D+Dm) in step S135, the speed control unit 340 terminates the process.

Meanwhile, when the speed control current Ip is less than or equal to the second threshold (D−Dn), the speed control unit 340 requests the controller 311 of the registration motor control unit 310 to decrease the rotational speed V of the registration motor 67 (step S136).

Also, when the speed control current Ip is greater than or equal to the first threshold (D+Dm), the speed control unit 340 requests the controller 311 of the registration motor control unit 310 to increase the rotational speed V of the registration motor 67 (step S137).

According to the third embodiment, the values of the driving currents of the intermediate transfer motor 64, the secondary transfer motor 65, and the registration motor 67 are obtained to calculate the reference value D every time when the rotational speed V of the registration motor 67 is changed. This configuration makes it possible to control the rotational speed V of the registration motor 67 more finely and in real time.

<Fourth Embodiment>

A fourth embodiment is described below with reference to the accompanying drawings. The fourth embodiment is different from the first embodiment in that the rotational speeds of the intermediate transfer motor 64 and the secondary transfer motor 65 are controlled before controlling the rotational speed of the registration motor 67. Below, differences from the first embodiment are mainly described. The same reference numbers are assigned to components corresponding to those in the first embodiment, and their descriptions are omitted.

Figure 14:
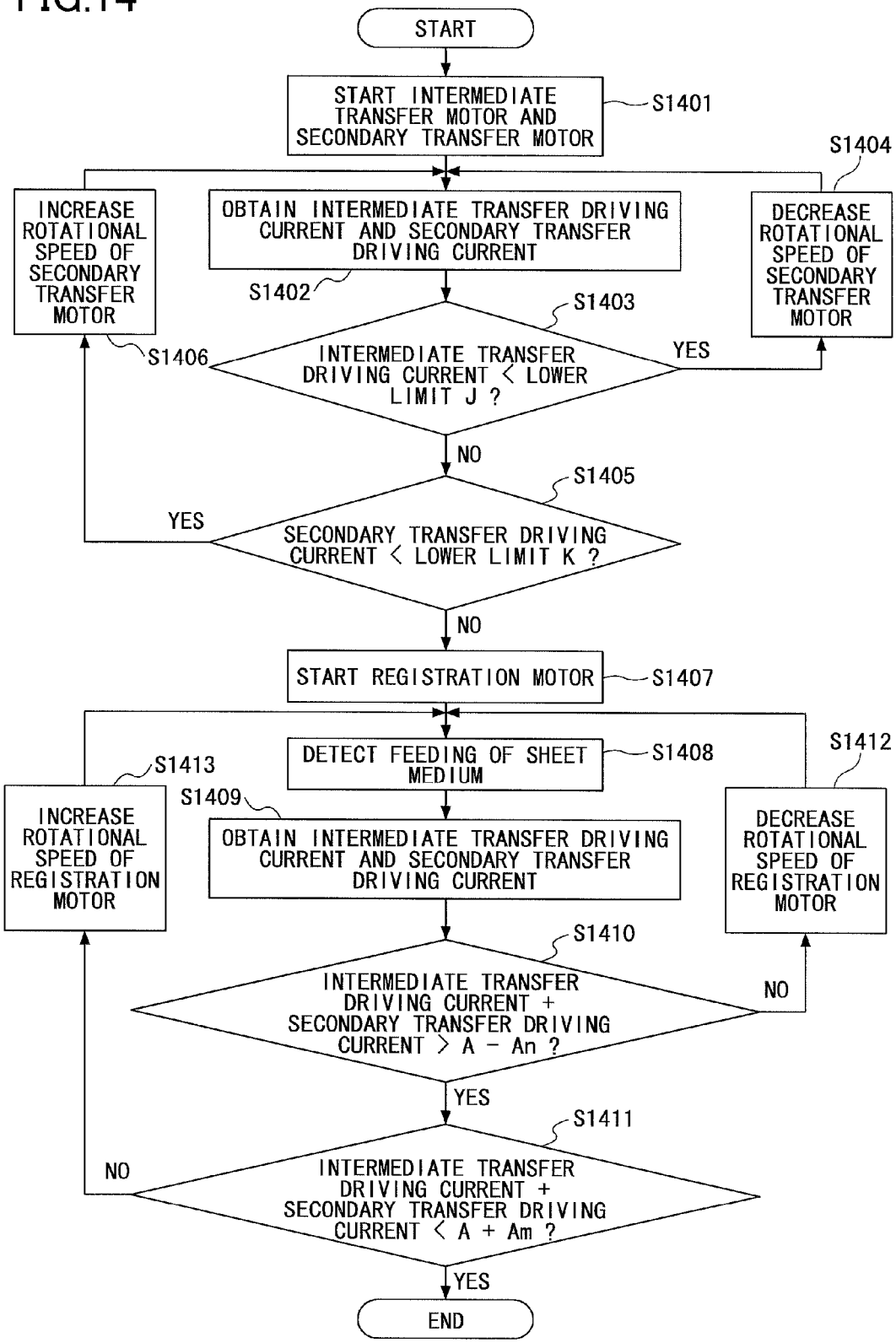
FIG. 14 is a flowchart illustrating an exemplary process performed by a motor control unit of a fourth embodiment.

FIG. 14 is a flowchart illustrating an exemplary process performed by the motor control unit 200 of the fourth embodiment. First, the motor control unit 200 starts the intermediate transfer motor 64 and the secondary transfer motor 65 (step S1401). Next, the motor control CPU 300 of the motor control unit 200 obtains the value of the intermediate transfer driving current of the intermediate transfer motor 64 from the A/D converter 323 and the value of the secondary transfer driving current of the secondary transfer motor 64 from the A/D converter 333, and stores the obtained values in the memory 240 (step S1402).

Next, the speed control unit 340 determines whether the value of the intermediate transfer driving current stored in the memory 240 is less than a lower limit J of the intermediate transfer driving current (step S1403). When the intermediate transfer driving current is less than the lower limit J in step S1403, the speed control unit 340 requests the secondary transfer motor control unit 330 to decrease the rotational speed of the secondary transfer motor 65 (step S1404).

Meanwhile, when the value of the intermediate transfer driving current is greater than or equal to the lower limit J, the speed control unit 340 determines whether the value of the secondary transfer driving current is less than a lower limit K (step S1405). When the secondary transfer driving current is less than the lower limit K in step S1405, the speed control unit 340 requests the secondary transfer motor control unit 330 to increase the rotational speed of the secondary transfer motor 65 (step S1406).

In the fourth embodiment, the lower limit J of the intermediate transfer driving current and the lower limit K of the secondary transfer driving current are determined in advance. For example, the lower limit J may be the value of the intermediate transfer driving current obtained when the intermediate transfer motor 64 enters an uncontrollable state in an experiment where the intermediate transfer driving current is gradually decreased by increasing the rotational speed of the secondary transfer motor 65. The lower limit K may be the value of the secondary transfer driving current obtained when the secondary transfer motor 65 enters an uncontrollable state in an experiment where the secondary transfer driving current is gradually decreased by decreasing the rotational speed of the secondary transfer motor 65.

When the secondary transfer driving current is greater than or equal to the lower limit K in step S1405, the motor control unit 200 starts the registration motor 67 (step S1407).

Subsequent steps S1408 through S1413 of FIG. 14 are substantially the same as steps S62 through S67 of FIG. 6, and therefore their descriptions are omitted here.

Thus, according to the fourth embodiment, the rotational speeds of the intermediate transfer motor 64 and the secondary transfer motor 65 are controlled before the registration motor 67 is started. This configuration makes it possible keep the intermediate transfer driving current and the secondary transfer driving current within appropriate ranges, and also makes it possible to optimize the relationship among the intermediate transfer motor 64, the secondary transfer motor 65, and the registration motor 67.

<Fifth Embodiment>

A fifth embodiment is described below with reference to the accompanying drawings. The fifth embodiment is different from the first embodiment in that cases where the rotational speed of the registration motor 67 cannot be changed are taken into consideration. Below, differences from the first embodiment are mainly described. The same reference numbers are assigned to components corresponding to those in the first embodiment, and their descriptions are omitted.

Figure 15:
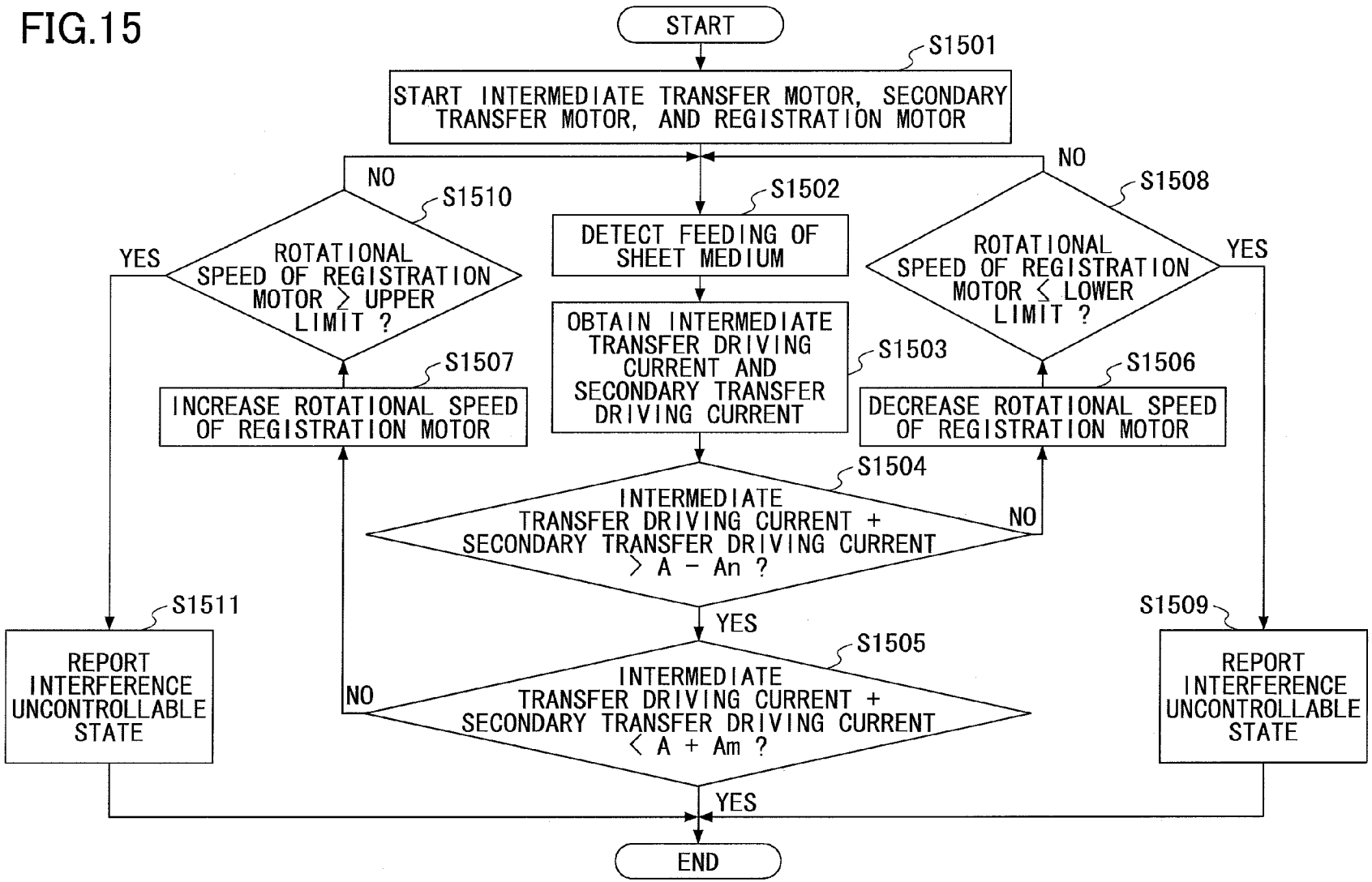
FIG. 15 is a flowchart illustrating an exemplary process performed by a motor control unit of a fifth embodiment.

FIG. 15 is a flowchart illustrating an exemplary process performed by the motor control unit 200 of the fifth embodiment.

Steps S1501 through S1507 of FIG. 15 are substantially the same as steps S61 through S67 of FIG. 6, and therefore their descriptions are omitted here.

Following step S1506, the speed control unit 340 determines whether the rotational speed of the registration motor 67 has become less than or equal to a lower limit (step S1508). When the rotational speed of the registration motor 67 is greater than the lower limit in step S1508, the speed control unit 340 returns to step S1502. Meanwhile, when the rotational speed of the registration motor 67 is less than or equal to the lower limit in step S1508, the speed control unit 340 reports an interference uncontrollable state (indicating that interference is not controllable) to the main control unit 110 (step S1509).

Also, following step S1507, the speed control unit 340 determines whether the rotational speed of the registration motor 67 has become greater than or equal to an upper limit (step S1510). When the rotational speed of the registration motor 67 is less than the upper limit in step S1510, the speed control unit 340 returns to step S1502. Meanwhile, when the rotational speed of the registration motor 67 is greater than or equal to the upper limit in step S1510, the speed control unit 340 reports the interference uncontrollable state to the main control unit 110 (step S1511).

When the interference uncontrollable state is reported, the main control unit 110 may display a message indicating the interference uncontrollable state on, for example, the operations unit 120.

Thus, according to the fifth embodiment, an abnormal state (interference uncontrollable state) is reported by, for example, displaying a message on the operations unit 120 when the rotational speed of the registration motor 67 reaches or exceeds the upper or lower limit. This configuration makes it possible to prevent an unstable control state caused when the rotational speed of the registration roller 67 is decreased too much and an overcurrent state caused when the rotational speed of the registration roller 67 is increased too much.

The upper and lower limits of the rotational speed of the registration motor 67 may be determined, for example, by experimentally changing the rotational speed of the registration motor 67 after controlling the rotational speeds of the intermediate transfer motor 64 and the secondary transfer motor 65 as described in the fourth embodiment. For example, a rotational speed at which the registration motor 67 enters the unstable control state may be determined by gradually decreasing the rotational speed, and the determined rotational speed may be used as the lower limit. Similarly, a rotational speed at which the registration motor 67 enters the overcurrent state may be determined by gradually increasing the rotational speed, and the determined rotational speed may be used as the upper limit. Here, the overcurrent state indicates a situation where the current flowing through a driving element such as the FET unit 210 becomes close to the rated current of the driving element.

In the above embodiments, the registration roller 66 is used as an example of the third rotator. However, any rotator that interferes with the first and second rotators may be referred to as the third rotator.

<Sixth Embodiment>

A sixth embodiment is described below with reference to the accompanying drawings. The sixth embodiment provides a sheet conveying motor control system where a server connected to an image forming apparatus controls the rotational speed of the registration motor 67.

Figure 16:
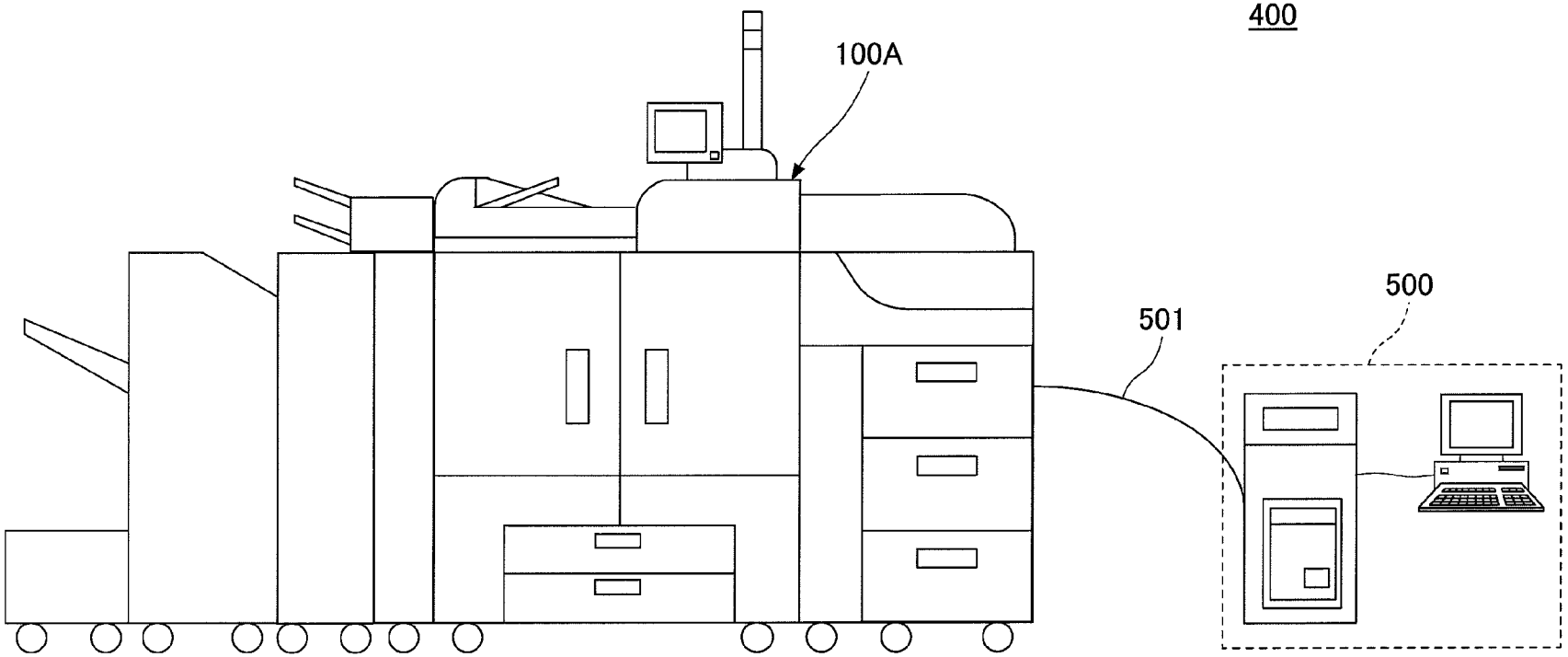
FIG. 16 is a drawing illustrating an exemplary configuration of a sheet conveying motor control system according a sixth embodiment.

FIG. 16 is a drawing illustrating an exemplary configuration of a sheet conveying motor control system 400 according the sixth embodiment.

The sheet conveying motor control system 400 of the sixth embodiment may include an image forming apparatus 100A and a server 500. The image forming apparatus 100A is different from the image forming apparatus 100 of the first embodiment in that the image forming apparatus 100A does not include the speed control unit 340 of the motor control CPU 300 and the memory 240. In the sixth embodiment, the speed control unit 340 and the memory 240 are included in the server 500.

Figure 17:
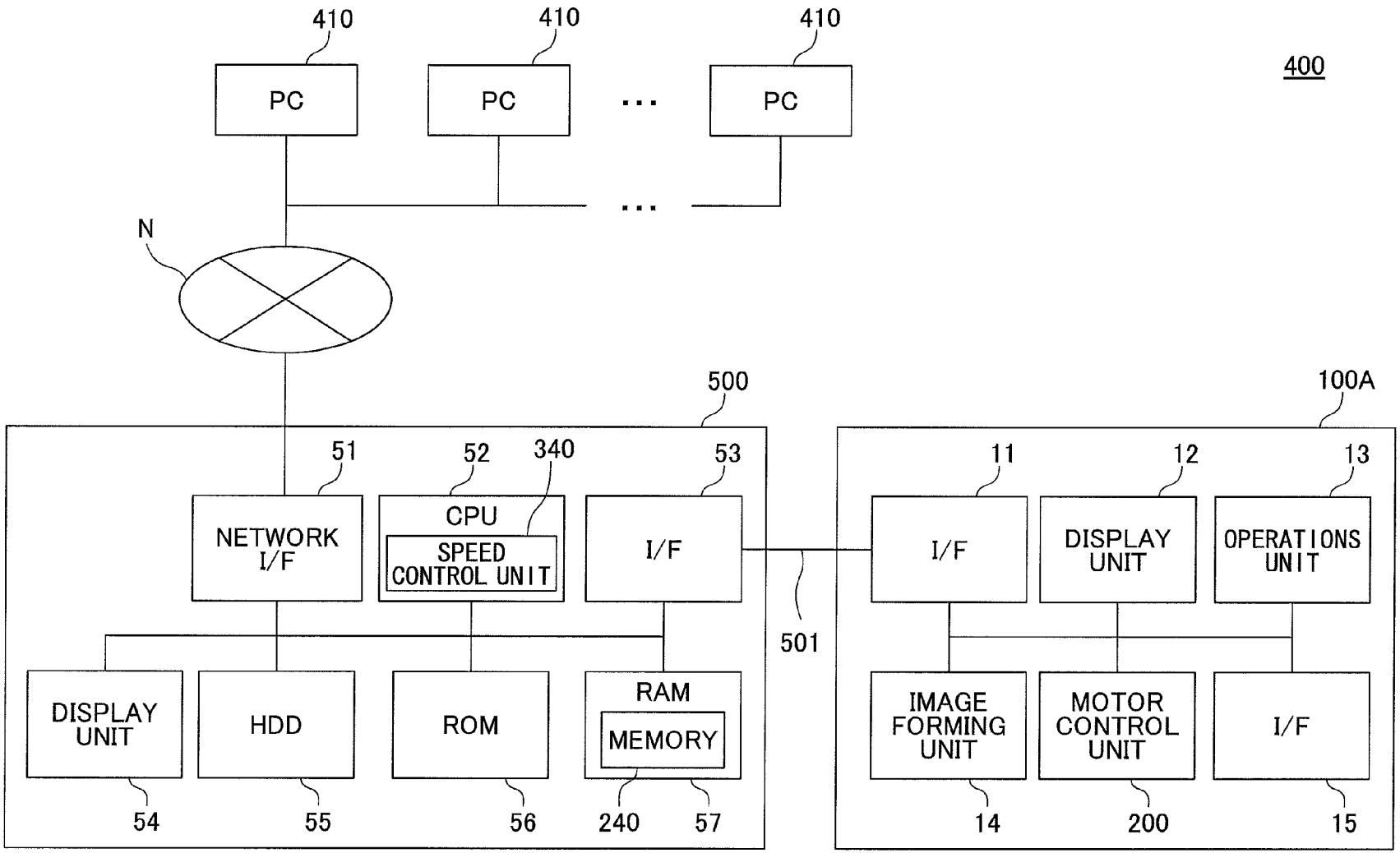
FIG. 17 is a drawing illustrating exemplary hardware configurations of an image forming apparatus and a server according to the sixth embodiment.

FIG. 17 is a drawing illustrating exemplary hardware configurations of the image forming apparatus 100A and the server 500 according to the sixth embodiment.

The server 500 may be implemented by a computer, and include a network interface (I/F) 51, a central processing unit (CPU) 52, an interface (I/F) 53, a display unit 54, a hard disk drive (HDD) 55, a read-only memory (ROM) 56, and a random access memory (RAM) 57 that are connected to each other via a bus. The server 500 is connected via a private line 501 to the image forming apparatus 100A. Alternatively, the server 500 and the image forming apparatus 100A may be connected to each other via any appropriate communication line other than the private line 501.

The CPU 52 performs various control processing and data processing and executes programs stored, for example, in the ROM 56 and the RAM 57. The CPU 52 also controls the entire server 500 by executing programs. The CPU 52 may include the speed control unit 340. The speed control unit 340 of the CPU 52 determines whether to change the rotational speed of the registration motor 67 based on the intermediate transfer driving current obtained from the intermediate transfer motor control unit 320 and the secondary transfer driving current obtained from the secondary transfer motor control unit 330. When it is determined to change the rotational speed of the registration motor 67, the CPU 52 requests the registration motor control unit 310 to change the rotational speed of the registration motor 67.

The HDD 55 is a non-volatile storage unit for storing various programs and data. For example, the HDD 55 may store an operating system (OS) and applications that provide various functions.

The ROM 56 is a non-volatile semiconductor memory (storage unit) that can retain data even when the power is turned off. The RAM 57 is a volatile semiconductor memory (storage unit) for temporarily storing programs and data. The RAM 57 may include the memory 240 for storing values including the values of the intermediate transfer driving current and the secondary transfer driving current.

The network I/F 51 allows the server 500 to communicate with other devices such as PCs 410 connected via a network N, such as a local area network (LAN) or a wide area network (WAN), implemented by wired and/or wireless data communication channels.

The I/F 53 connects the server 500 via the private line 501 to an interface (I/F) 11 of the image forming apparatus 100A.

The image forming apparatus 100A is connected via the private line 501 with the server 500, and may include the I/F 11, a display unit 12, an operations unit 13, an image forming unit 14, the motor control unit 200, and another interface (I/F) 15 that are connected to each other via a bus.

The I/F 11 connects the image forming apparatus 100A via the private line 501 to the I/F 53 of the server 500.

The display unit 12 and the operations unit 13 may be implemented by, for example, a liquid crystal display (LCD) including key switches (or hardware keys) and a touch panel (that provides a graphical user interface (GUI) such as software keys). In other words, the display unit 12 and the operations unit 13 are user interfaces (UI) of the image forming apparatus 100A for displaying and/or inputting information.

The image forming unit 14 may include components such as a photoconductor unit and a fusing unit for forming an image on a sheet medium according to image data.

Programs to be executed on the server 500 and/or the image forming apparatus 100A (and/or the image forming apparatus 100) may be stored in a non-transitory, computer-readable storage medium such as a CD-ROM, a flexible disk (FD), a CD-R, or a digital versatile disk (DVD), and installed into the server 500 and/or the image forming apparatus 100A from the storage medium.

Alternatively, programs to be executed on the server 500 and/or the image forming apparatus 100A (and/or the image forming apparatus 100) may be downloaded and installed from a computer connected to a network such as the Internet. Further, programs to be executed on the server 500 and/or the image forming apparatus 100A (and/or the image forming apparatus 100D may be distributed via a network such as the Internet.

In the sheet conveying motor control system 400 of the sixth embodiment, the speed control unit 340 is provided in the server 500. Alternatively, the speed control unit 340 may be provided in the PC 410 connected via the network N to the image forming apparatus 100A.

The speed control unit 340 of the server 500 of the sixth embodiment may be configured to display a message indicating an abnormal state on the display unit 54 when the rotational speed of the registration motor 67 reaches or exceeds the upper limit or the lower limit.

An aspect of this disclosure provides a sheet conveying device, an image forming apparatus, a sheet conveying motor control system, and a storage medium storing a drive control program that make it possible to properly control the rotation of three or more rotators and to thereby reduce the interference among the rotators.

A sheet conveying device, an image forming apparatus, a sheet conveying motor control system, and a storage medium according to the embodiments are described above. However, the present invention is not limited to the specifically disclosed embodiments, and variations and modifications may be made without departing from the scope of the present invention.

What is claimed is:

1. A sheet conveying device, comprising:

a first rotator, a second rotator, and a third rotator, at least one of which being configured to convey a sheet medium;

a first detection unit configured to detect a first control factor for controlling a first motor that rotates the first rotator;

a second detection unit configured to detect a second control factor for controlling a second motor that rotates the second rotator;

a motor control unit configured to control a rotational speed of a third motor that rotates the third rotator; and a speed control unit configured to request the motor control unit to change the rotational speed of the third motor based on a sum of the first control factor and the second control factor.

2. The sheet conveying device as claimed in claim 1, wherein the speed control unit is configured to determine whether the sum of the first control factor and the second control factor is within a predetermined range, when the sum is less than the predetermined range, request the motor control unit to decrease the rotational speed of the third motor such that the sum falls within the predetermined range, and when the sum is greater than the predetermined range, request the motor control unit to increase the rotational speed of the third motor such that the sum falls within the predetermined range.

3. The sheet conveying device as claimed in claim 2, wherein the speed control unit is configured to calculate a reference value by adding the first control factor obtained when the first motor is at a first target rotational speed and the second control factor obtained when the second motor is at a second target rotational speed, calculate a maximum value of the predetermined range by adding the reference value and a maximum allowable increase of the first control factor or the second control factor, and calculate a minimum value of the predetermined range by subtracting a maximum allowable decrease of the first control factor or the second control factor from the reference value.

4. The sheet conveying device as claimed in claim 3, wherein the speed control unit is configured to calculate the reference value by subtracting a third control factor for controlling the third motor obtained when the third motor is at a third target rotational speed from a sum of the first control factor obtained when the first motor is at the first target rotational speed and the second control factor obtained when the second motor is at the second target rotational speed.

5. The sheet conveying device as claimed in claim 4, wherein an upper limit and a lower limit of the third control factor are predetermined; and the speed control unit is configured to report an uncontrollable state when the third control factor exceeds the upper limit or the lower limit as a result of changing the rotational speed of the third motor.

6. The sheet conveying device as claimed in claim 1, wherein the first control factor is a first driving current for driving the first motor; and the second control factor is a second driving current for driving the second motor.

7. The sheet conveying device as claimed in claim 1, wherein the first control factor is a first torque command value for the first motor; and the second control factor is a second torque command value for the second motor.

8. An image forming apparatus comprising the sheet conveying device of claim 1.

9. A non-transitory computer-readable storage medium storing program code for causing a sheet conveying device to perform a method, wherein the sheet conveying device includes a first rotator, a second rotator, and a third rotator, at least one of which being configured to convey a sheet medium, the method comprising:

detecting a first control factor for controlling a first motor that rotates the first rotator;

detecting a second control factor for controlling a second motor that rotates the second rotator; and changing a rotational speed of a third motor for rotating the third rotator based on a sum of the first control factor and the second control factor.

10. A system, comprising:

a sheet conveying device including a first rotator, a second rotator, and a third rotator, at least one of which being configured to convey a sheet medium; and a computer connected to the sheet conveying device, wherein the sheet conveying device further includes a first detection unit configured to detect a first control factor for controlling a first motor that rotates the first rotator, a second detection unit configured to detect a second control factor for controlling a second motor that rotates the second rotator, and a motor control unit configured to control a rotational speed of a third motor that rotates the third rotator; and the computer includes a speed control unit configured to request the motor control unit of the sheet conveying device to change the rotational speed of the third motor based on a sum of the first control factor and the second control factor.

* * * * *